US009578897B2

(12) United States Patent
Gladden et al.

(10) Patent No.: US 9,578,897 B2
(45) Date of Patent: Feb. 28, 2017

(54) COMBUSTIBLE HEAT SOURCE FOR A SMOKING ARTICLE

(75) Inventors: Thomas Gladden, Cormondreche (CH); Laurent Poget, Bussigny (CH); Evan Jochnowitz, Neuchatel (CH); Stephane Roudier, Colombier (CH); Alexandre Malgat, Rouffach (FR); Samuel Bonnely, Cormondreche (CH)

(73) Assignee: Philip Morris Products S.A., Neuchatel (CH)

( * ) Notice: Subject to any disclaimer, the term of this patent is extended or adjusted under 35 U.S.C. 154(b) by 460 days.

(21) Appl. No.: 14/123,300

(22) PCT Filed: Jun. 1, 2012

(86) PCT No.: PCT/EP2012/060411

§ 371 (c)(1),
(2), (4) Date: Feb. 13, 2014

(87) PCT Pub. No.: WO2012/164077

PCT Pub. Date: Dec. 6, 2012

(65) Prior Publication Data

US 2014/0326260 A1 Nov. 6, 2014

(30) Foreign Application Priority Data

Jun. 2, 2011 (EP) ..... 11250578

(51) Int. Cl.

| | |
|---|---|
| ***A24F 47/00*** | (2006.01) |
| ***F23Q 2/18*** | (2006.01) |
| ***A24B 15/16*** | (2006.01) |

(52) U.S. Cl.

CPC ..... *A24F 47/004* (2013.01); *A24B 15/165* (2013.01); *A24F 47/006* (2013.01); *F23Q 2/18* (2013.01)

(58) Field of Classification Search

USPC ..... 131/253, 329, 330

See application file for complete search history.

(56) References Cited

U.S. PATENT DOCUMENTS

| | | | |
|---|---|---|---|
| 4,474,191 | A | 10/1984 | Steiner |
| 4,596,258 | A | 6/1986 | Steiner |

(Continued)

FOREIGN PATENT DOCUMENTS

| | | |
|---|---|---|
| CN | 86105536 | 2/1987 |
| CN | 87101955 | 2/1988 |

(Continued)

OTHER PUBLICATIONS

PCT International Search Report and Written Opinion dated Oct. 5, 2012 for PCT/EP2012/060411.

(Continued)

*Primary Examiner* — Dennis Cordray

(74) *Attorney, Agent, or Firm* — Mueting, Raasch & Gebhardt, P.A.

(57) ABSTRACT

A combustible heat source (4) for a smoking article (2) comprises carbon and at least one ignition aid, wherein the ignition aid is present in an amount of at least 20 percent by dry weight of the combustible heat source. The combustible heat source (4) has a first portion and an opposed second portion. At least part (4*b*) of the combustible heat source (4) between the first portion and the second portion is wrapped in a combustion resistant wrapper (22) that is one or both of heat conducting and substantially oxygen impermeable. Upon ignition of the first portion of the combustible heat source (4), the second portion of the combustible heat source increases in temperature to a first temperature. During subsequent combustion of the combustible heat source (4), (Continued)

the second portion of the combustible heat source (4) maintains a second temperature lower than the first temperature.

24 Claims, 9 Drawing Sheets

(56) References Cited

U.S. PATENT DOCUMENTS

| | | | |
|---|---|---|---|
| 4,714,082 | A | 12/1987 | Banerjee et al. |
| 4,819,665 | A | 4/1989 | Roberts et al. |
| 5,040,551 | A | 8/1991 | Schlatter et al. |
| 5,040,552 | A | 8/1991 | Schleich et al. |
| 5,060,667 | A | 10/1991 | Strubel et al. |
| 5,076,297 | A | 12/1991 | Farrier et al. |
| 5,146,934 | A | 9/1992 | Deevi et al. |
| 5,156,170 | A | 10/1992 | Clearman et al. |
| 5,178,167 | A | 1/1993 | Riggs et al. |
| 5,188,130 | A | 2/1993 | Hajaligol et al. |
| 5,240,014 | A | 8/1993 | Deevi et al. |
| 5,246,018 | A | 9/1993 | Deevi |
| 5,247,947 | A | 9/1993 | Clearman et al. |
| 5,247,949 | A | 9/1993 | Deevi |
| 5,285,798 | A | 2/1994 | Banerjee et al. |
| 5,468,266 | A | 11/1995 | Bensalem et al. |
| 5,595,577 | A | 1/1997 | Bensalem et al. |
| 6,578,584 | B1 | 6/2003 | Beven et al. |
| 7,290,549 | B2 | 11/2007 | Banerjee et al. |
| 8,061,361 | B2 | 11/2011 | Maeder |
| 2012/0080042 | A1 | 4/2012 | Nishimura |

FOREIGN PATENT DOCUMENTS

| | | | |
|---|---|---|---|
| CN | 1046665 | | 11/1990 |
| CN | 101778578 | | 7/2010 |
| EP | 0236992 | | 9/1987 |
| EP | 0337507 | A2 | 10/1989 |
| EP | 0337508 | A2 | 10/1989 |
| EP | 0340808 | | 11/1989 |
| EP | 0371285 | A2 | 6/1990 |
| EP | 0405190 | A2 | 1/1991 |
| EP | 0117355 | B1 | 3/1991 |
| EP | 0 627 174 | A1 | 12/1994 |
| GB | 1033674 | | 6/1966 |
| GB | 1083761 | | 9/1967 |
| JP | S59-501812 | | 11/1984 |
| JP | H06-183871 | | 7/1994 |
| JP | H07-145395 | | 6/1995 |
| JP | 2008-505990 | | 2/2008 |
| JP | 2009-529872 | | 8/2009 |
| JP | 2010/535530 | | 11/2010 |
| JP | 2011-505823 | | 3/2011 |
| JP | 2012/502658 | | 2/2012 |
| WO | WO 2006/002001 | | 1/2006 |
| WO | WO 2007/108878 | | 9/2007 |
| WO | WO 2009/022232 | | 2/2009 |
| WO | WO 2009/074870 | | 6/2009 |
| WO | WO 2009/092862 | A1 | 7/2009 |
| WO | WO 2010/033665 | | 3/2010 |
| WO | WO 2010/146693 | | 12/2010 |

OTHER PUBLICATIONS

Extended European Search Report for EP Application No. 11250578.9 dated Jan. 25, 2012 (6 pages).

Submission of Third Party Obversations issued in Japanese Patent Application No. 2014-513207 dated Dec. 25, 2015 (22 pages).

Hiroki, Tagawa, "Thermal Decomposition of Nitrates," pp. 41-47, 1987.

Office Action issued in China for Application No. 201280032154.8 dated Aug. 11, 2015 (19 pages). English translation included.

Office Action issued in Japan for Application No. 2014-513207 dated Mar. 14, 2016 (6 pages). English translation included.

COMBUSTIBLE HEAT SOURCE FOR A SMOKING ARTICLE

This application is a U.S. National Stage Application of International Application No. PCT/EP2012/060411, filed 1 Jun. 2012, which was published in English on 6 Dec. 2012 as International Patent Publication WO 2012/164077 A1. International Application No. PCT/EP2012/060411 claims priority to European Application No. 11250578.9, filed 2 Jun. 2011.

The present invention relates to a combustible heat source for use in a smoking article and to a smoking article comprising a combustible heat source according to the invention.

A number of smoking articles in which tobacco is heated rather than combusted have been proposed in the art. One aim of such heated smoking articles is to reduce known harmful smoke constituents produced by the combustion and pyrolytic degradation of tobacco in conventional cigarettes. Typically in heated smoking articles, an aerosol is generated by the transfer of heat from a combustible fuel element or heat source to a physically separate aerosol-generating material, which may be located within, around or downstream of the heat source. In use the combustible heat source of the heated smoking article is lit and volatile compounds released from the aerosol-generating material by heat transfer from the combustible heat source are entrained in air drawn through the heated smoking article. As the released compounds cool they condense to form an aerosol that is inhaled by the consumer.

For example, U.S. Pat. No. 4,714,082 discloses smoking articles comprising a high density combustible fuel element, a physically separate aerosol-generating means and a heat-conducting member. The heat-conducting member contacts the fuel element and the aerosol-generating means around at least a portion of their peripheral surfaces and conducts heat from the burning fuel element to the aerosol-generating means. In the smoking articles of U.S. Pat. No. 4,714,082, the heat-conducting member preferably is recessed from the lighting end of the fuel element and forms a conductive container that encloses the aerosol-generating means along its entire length.

WO-A2-2009/022232 discloses a smoking article comprising a combustible heat source, an aerosol-generating substrate downstream of the combustible heat source and a heat-conducting element around and in contact with a rear portion of the combustible heat source and an adjacent front portion of the aerosol-generating substrate. In the smoking article of WO-A2-2009/022232, aerosol-generating substrate extends at least about 3 mm downstream beyond the heat-conducting element.

Advantageously, the combustion temperature of a combustible heat source for use in a heated smoking article should not be so high as to result in combustion or thermal degradation of the aerosol forming material during use of the heated smoking article. However, the combustion temperature of the combustible heat source should also advantageously be sufficiently high to generate enough heat to release sufficient volatile compounds from the aerosol forming material to produce an acceptable aerosol, especially during early puffs. To avoid a delay between a consumer igniting the combustible heat source and an acceptable aerosol being produced, the combustible heat source should rapidly reach an appropriate combustion temperature after ignition thereof.

A variety of combustible carbon-based and non-carbon-based heat sources for use in heated smoking articles have previously been proposed in the art. Combustible carbon-based and non-carbon-based heat sources and methods for producing such heat sources are described in, for example, U.S. Pat. No. 5,076,297 and U.S. Pat. No. 5,146,934.

Although many combustible carbon-based heat sources are known in the art, such heat sources are often difficult to ignite with a conventional yellow flame cigarette lighter. Additionally, when used in a heated smoking article, known combustible carbon-based heat sources often do not generate enough heat after ignition thereof to produce an acceptable aerosol during early puffs.

It has been proposed in the art to include oxidizing agents and other additives in combustible carbon-based heat sources in order to improve the ignition and combustion properties thereof. However, generally such additives have only been included in small amounts relative to the total weight of the combustible carbon-based heat source. For example, EP-A1-0 627 174 discloses that oxidants such as perchlorates, chlorates, nitrates and permanganates may be included in the carbonaceous heat sources disclosed therein in an amount of between about 0.05% and 10% by weight of the heat source and preferably between about 0.2% and 4%.

There remains a need for a combustible heat source that generates enough heat to produce an acceptable aerosol during early puffs of a heated smoking article, but not so much heat as to result in combustion or thermal degradation of the aerosol-generating material. Moreover, there is a need for such a combustible heat source that is mechanically and chemically stable at ambient temperatures and humidity and can be ignited easily and rapidly with a conventional yellow flame cigarette lighter.

According to the invention there is provided a combustible heat source for a smoking article comprising carbon and at least one ignition aid, wherein the at least one ignition aid is present in an amount of at least about 20 percent by dry weight of the combustible heat source. The combustible heat source has a first portion and an opposed second portion, wherein at least part of the combustible heat source between the first portion and the second portion is wrapped in a combustion resistant wrapper that is one or both of heat conducting and substantially oxygen impermeable. Upon ignition of the first portion of the combustible heat source the second portion of the combustible heat source increases in temperature to a first temperature and during subsequent combustion of the combustible heat source the second portion of the combustible heat source maintains a second temperature lower than the first temperature.

As used herein, the term 'ignition aid' is used to denote a material that releases one or both of energy and oxygen during ignition of the combustible heat source.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. As discussed further below, even when present in a large amount relative to the total weight of the combustible heat source, such alkali metal burn salts do not release enough energy during ignition of a combustible heat source to produce an acceptable aerosol during early puffs.

As used herein, the terms 'first portion' and 'second portion' are used to denote two spaced-apart regions of the combustible heat source.

As used herein, the term 'combustion resistant wrapper' is used to denote a wrapper that remains substantially intact throughout combustion of the combustible heat source.

As used herein, the term 'wrapped' is used to denote that the combustion resistant wrapper is around and in direct contact with the periphery of the combustible heat source.

According to the invention there is also provided a smoking article comprising a combustible heat source according to the invention.

In particular, according to the invention there is provided a smoking article comprising a combustible heat source according to the invention; and an aerosol-generating substrate.

According to the invention there is further provided a smoking article comprising a combustible heat source according to the invention; and an aerosol-generating substrate downstream of the combustible heat source, wherein the first portion of the combustible heat source is an upstream end of the combustible heat source and the second portion of the combustible heat source is a downstream end of the combustible heat source.

As used herein, the terms 'upstream' and 'front', and 'downstream' and 'rear', are used to describe the relative positions of components, or portions of components, of smoking articles according to the invention in relation to the direction of air drawn through the smoking articles during use thereof.

Preferably, at least a rear part of the combustible heat source is wrapped in the combustion resistant wrapper.

Preferably, at least a rear part of the combustible heat source and at least a front part of the aerosol-generating substrate are wrapped in the combustion resistant wrapper. In such embodiments, the combustion resistant wrapper is around and in direct contact with the periphery of at least a rear part of the combustible heat source and the periphery of at least a front part of the aerosol-generating substrate.

Preferably, a rear part of the aerosol-generating substrate is not wrapped in the combustion resistant wrapper.

Preferably, a front part of the combustible heat source is not wrapped in the combustion resistant wrapper.

Upon ignition of the first portion thereof, combustible heat sources according to the invention undergo a two-stage combustion process. In an initial first stage combustible heat sources according to the invention exhibit a 'boost' in temperature and in a subsequent second stage the combustible heat sources undergo sustained combustion at a lower temperature. This two-stage combustion process is reflected in the temperature profile of the second portion of combustible heat sources according to the invention. The second portion of combustible heat sources according to the invention initially increases in temperature to a first 'boost' temperature and then subsequently decreases in temperature to a second 'cruising' temperature lower than the first temperature. The difference between the first temperature and the second temperature of the second portion of combustible heat sources according to the invention establishes the magnitude of the 'boost' in temperature of the second portion of the combustible heat sources during the first stage of combustion of the combustible heat sources.

It will be appreciated that the second portion of combustible heat sources according to the invention may or may not itself combust during the first and second stages of combustion of the combustible heat sources.

The initial 'boost' in temperature of the second portion of combustible heat sources according to the invention arises due to very rapid propagation of heat throughout the entirety of the combustible heat sources upon ignition of the first portion thereof. The very rapid propagation of heat may be the result of a chain reaction in which a part of the combustible heat sources that is ignited triggers the ignition of an adjacent unignited part of the combustible heat sources.

In use in smoking articles according to the invention, the rapid increase in temperature of the second portion of combustible heat sources according to the invention to the first 'boost' temperature quickly raises the temperature of the aerosol-generating substrate of the smoking articles to a level at which volatile organic aroma and flavour compounds are generated from the aerosol-generating substrate. This ensures that smoking articles according to the invention produce a sensorially acceptable aerosol as of the first puff. The subsequent decrease in temperature of the second portion of combustible heat sources according to the invention to the second 'cruising' temperature ensures that the temperature of the aerosol-generating substrate of the smoking articles does not reach a level at which combustion or thermal degradation of the aerosol-generating substrate occurs.

Controlling the temperature of the second portion of combustible heat sources according to the invention in the manner described above advantageously enables smoking articles according to the invention to be provided that not only produce a sensorially acceptable aerosol during early puffs, but in which combustion or thermal degradation of the aerosol-generating substrate is also substantially avoided.

Combustible heat sources according to the invention comprise at least one ignition aid, wherein the at least one ignition aid is present in an amount of at least about 20 percent by dry weight of the combustible heat source.

The quantity of one or both of energy and oxygen released by the at least one ignition aid during ignition of the combustible heat source must be sufficient to result in the combustible heat source undergoing the two-stage combustion process described above.

It will be appreciated that the amount of at least one ignition aid that must be included in a combustible heat source according to the invention in order to achieve the two-stage process described above will vary depending on the specific at least one ignition aid included in the combustible heat source.

In general, the greater the quantity of one or both of energy and oxygen released by the at least one ignition aid per unit mass thereof, the lower the amount of the at least one ignition aid that must be included in a combustible heat source according to the invention in order to achieve the two-stage combustion process described above.

In some embodiments, the at least one ignition aid is preferably present in an amount of at least about 25 percent, more preferably at least about 30 percent, most preferably at least about 40 percent by dry weight of the combustible heat source.

Preferably, the at least on ignition aid is present in an amount of less than about 65 percent by dry weight of the combustible heat source.

In some embodiments, the at least one ignition aid is preferably present in an amount of at less than about 60 percent, more preferably less than about 55 by dry weight of the combustible heat source, most preferably less than about 50 by dry weight of the combustible heat source.

Unless otherwise stated, the temperatures of combustible heat sources according to the invention given in the following description of the invention are temperatures of the combustible heat sources as measured in isolation. As used herein, the terms 'in isolation' and 'isolated' are used to describe a combustible heat source according to the invention when separate from the remainder of a smoking article according to the invention.

The temperatures of isolated combustible heat sources according to the invention given in the following description are measured using a thermocouple inserted a short distance of between about 1 mm and about 2 mm into a distal region of the second portion of the combustible heat source.

As used herein, the term 'distal region' is used to denote a region of the second portion of the combustible heat source situated furthest from the first portion of the combustible heat source that is ignited.

Preferably, the first temperature of the second portion of combustible heat sources according to the invention is at least about 400° C.

Preferably, the first temperature of the second portion of combustible heat sources according to the invention is less than or equal to about 1200° C.

Preferably, the first temperature of the second portion of combustible heat sources according to the invention is between about 400° C. and about 1200° C.

The second temperature of the second portion of combustible heat sources according to the invention is lower than the first temperature of the second portion of combustible heat sources according to the invention.

Preferably, the second temperature of the second portion of combustible heat sources according to the invention is at least about 200° C.

Preferably, the second temperature of the second portion of combustible heat sources according to the invention is less than or equal to about 1000° C.

Preferably, the second temperature of the second portion of combustible heat sources according to the invention is between about 200° C. and about 1000° C.

Preferably, the first temperature of the second portion of combustible heat sources according to the invention is at least about 400° C. and the second temperature of the second portion of combustible heat sources according to the invention is at least about 200° C.

Preferably, the first temperature of the second portion of combustible heat sources according to the invention is less than or equal to about 1200° C. and the second temperature of the second portion of combustible heat sources according to the invention is less than or equal to about 1000° C.

Preferably, the second temperature of the second portion of combustible heat sources according to the invention is between about 200° C. and about 1000° C. lower than the first temperature of the second portion of the combustible heat sources. More preferably the second temperature of the second portion of combustible heat sources according to the invention is between about 200° C. and about 500° C. lower than the first temperature of the second portion of the combustible heat sources.

The initial 'boost' in temperature of the second portion of combustible heat sources according to the invention is preferably initiated at low temperature by igniting the first portion of the combustible heat sources using a low energy lighter or other ignition means.

Preferably, the ignition temperature of the first portion of combustible heat sources according to the invention is between about 200° C. and about 1000° C., more preferably between about 300° C. and about 800° C., most preferably between about 300° C. and about 500° C.

In particularly preferred embodiments of the invention, the first portion of combustible heat sources according to the invention can be ignited with a conventional yellow flame cigarette lighter in 15 seconds or less, more preferably in 10 seconds or less, most preferably in 5 seconds or less.

As used herein, the term 'ignited' is used to mean that at least part of the first portion of the combustible heat source is sustainably combusting and that the combustion is propagating to other parts of the combustible heat source.

The temperature of the second portion of combustible heat sources according to the invention is not directly influenced by the temperature of the lighter or other ignition means used to ignite the first portion thereof.

Upon ignition of the first portion of combustible heat sources according to the invention, the second portion of the combustible heat sources preferably increases in temperature to the first temperature at a rate of between about 100° C./second and about 1000° C./second, more preferably at a rate of between about 400° C./second and about 800° C./second.

Upon ignition of the first portion of combustible heat sources according to the invention, the second portion of the combustible heat sources preferably increases in temperature to the first temperature within between about L/20 seconds and about 2 L seconds, more preferably within between about L/10 seconds and about L seconds, most preferably within between about L/10 seconds and about L/2 seconds. As used herein, 'L' is used to denote the distance in mm between the first portion of combustible heat sources according to the invention that is ignited and the opposed second portion of the combustible heat sources.

For example, where the distance in mm between the first portion and the second portion of a combustible heat source according to the invention is about 10 mm, upon ignition of the first portion of the combustible heat source the second portion of the combustible heat source preferably increases in temperature to the first temperature within between about 0.5 seconds and about 20 seconds, more preferably within between about 1 second and about 10 seconds, most preferably within between about 1 second and about 5 seconds.

As described above, having rapidly increased to the first 'boost' temperature, the temperature of the second portion of combustible heat sources according to the invention then subsequently decreases to the second 'cruising' temperature. Preferably, the second portion of combustible heat sources according to the invention decreases in temperature from the first temperature to the second temperature within between about 1 second and about 30 seconds, more preferably between about 1 second and about 20 seconds, most preferably between about 1 second and about 15 seconds. In particularly preferred embodiments of the invention, the second portion of combustible heat sources according to the invention decreases in temperature from the first temperature to the second temperature within between about 1 second and about 10 seconds, more preferably within between about 1 second and about 5 seconds.

Preferably, the temperature of the second portion of combustible heat sources according to the invention remains substantially stable at the second temperature for at least about 3 minutes, more preferably for at least 4 minutes, most preferably for at least 5 minutes.

As used herein, the term 'substantially stable' is used to describe a temperature variation of less than or equal to about 50° C.

The first and second temperatures of the second portion of combustible heat sources according to the invention as measured within smoking articles according to the invention may be the same as the first and second temperatures of the second portion of combustible heat sources according to the invention as measured in isolation.

However, it will be appreciated that in use in smoking articles according to the invention, the temperature of the second portion of combustible heat sources according to the invention may be affected by, for example, the composition, quantity, shape, dimensions and location of the aerosol-generating substrate and other components of the smoking articles. Consequently, the first and second temperatures of the second portion of combustible heat sources according to the invention as measured within smoking articles according to the invention may differ from the first and second temperatures of the second portion of combustible heat sources according to the invention as measured in isolation.

Combustible heat sources according to the invention may be produced having different shapes and dimensions depending upon their intended use.

Preferably, combustible heat sources according to the invention are elongate combustible heat sources. The first portion of elongate combustible heat sources according to the invention is a first end of the elongate combustible heat sources and the second portion of elongate combustible heat sources according to the invention is an opposed second end of the elongate combustible heat sources.

According to a preferred embodiment of the invention there is provided an elongate combustible heat source for a smoking article comprising carbon and at least one ignition aid, wherein the at least one ignition aid is present in an amount of at least about 20 percent by dry weight of the combustible heat source, the elongate combustible heat source having an upstream end and an opposed downstream end, wherein at least part of the elongate combustible heat source between the upstream end and the downstream end is wrapped in a combustion resistant wrapper that is one or both of heat conducting and substantially oxygen impermeable and wherein upon ignition of the upstream end of the elongate combustible heat source the downstream end of the elongate combustible heat source increases in temperature to a first temperature and wherein during subsequent combustion of the elongate combustible heat source the downstream end of the elongate combustible heat source maintains a second temperature lower than the first temperature.

Preferably, elongate combustible heat sources according to the invention are substantially rod-shaped.

More preferably, elongate combustible heat sources according to the invention are substantially cylindrical. The first portion of cylindrical combustible heat sources according to the invention is a first end face of the cylindrical combustible heat sources and the second portion of cylindrical combustible heat sources according to the invention is an opposed second end face of the cylindrical combustible heat sources.

According to a particularly preferred embodiment of the invention there is provided a cylindrical combustible heat source for a smoking article comprising carbon and at least one ignition aid, wherein the at least one ignition aid is present in an amount of at least about 20 percent by dry weight of the combustible heat source, the cylindrical combustible heat source having an upstream end face and an opposed downstream end face, wherein at least part of the cylindrical combustible heat source between the upstream end face and the downstream end face is wrapped in a combustion resistant wrapper that is one or both of heat conducting and substantially oxygen impermeable and wherein upon ignition of the upstream end face of the cylindrical combustible heat source the downstream end face of the cylindrical combustible heat source increases in temperature to a first temperature and wherein during subsequent combustion of the cylindrical combustible heat source the downstream end face of the cylindrical combustible heat source maintains a second temperature lower than the first temperature.

Preferably, elongate combustible heat sources according to the invention are of substantially circular, oval or elliptical transverse cross-section.

Preferably, elongate combustible heat sources according to the invention have a diameter of between about 5 mm and about 9 mm, more preferably of between about 7 mm and about 8 mm. As used herein, the term 'diameter' denotes the maximum transverse dimension of elongate combustible heat sources according to the invention.

Preferably, elongate combustible heat sources according to the invention are of substantially uniform diameter. However, elongate combustible heat sources according to the invention may alternatively be tapered so that the diameter of the downstream end of the elongate combustible heat sources is greater than the diameter of the upstream end of the elongate combustible heat sources.

Preferably, elongate combustible heat sources according to the invention have a length of between about 7 mm and about 17 mm, more preferably of between about 11 mm and about 15 mm, most preferably of between about 11 mm and about 13 mm. As used herein, the term 'length' denotes the maximum longitudinal dimension of elongate combustible heat sources according to the invention between the upstream end and the downstream end thereof.

Elongate combustible heat sources according to the invention may be wrapped in a combustion resistant wrapper along substantially their entire length. Alternatively, elongate combustible heat sources according to the invention may be wrapped in a combustion resistant wrapper along only a portion of their length.

Preferably, at least a downstream part of elongate combustible heat sources according to the invention is wrapped in the combustion resistant wrapper.

Preferably, an upstream part of elongate combustible heat sources according to the invention is not wrapped in the combustion resistant wrapper.

Combustible heat sources according to the invention may be wrapped in a combustion resistant wrapper that is heat-conducting.

In use in smoking articles according to the invention, heat generated during combustion of combustible heat sources according to the invention wrapped in a heat-conducting combustion resistant wrapper may be transferred by conduction to the aerosol-generating substrate of the smoking articles via the heat-conducting combustion resistant wrapper. This may significantly impact the temperature of the second portion of the combustible heat sources. Heat drain exerted by the conductive heat transfer may significantly lower the temperature of the second portion of the combustible heat sources. This increases the difference between the first temperature and the second temperature of the second portion of the combustible heat sources and thus the magnitude of the 'boost' in temperature of the second portion of the combustible heat sources.

In use, in such embodiments the heat drain exerted by conductive heat transfer through the heat-conducting combustion resistant wrapper may keep the second temperature of the second portion of the combustible heat sources significantly below the self-ignition temperature of the second portion of the combustible heat sources.

Alternatively or in addition, combustible heat sources according to the invention may be wrapped in an oxygen-restricting combustion resistant wrapper that restricts or prevents oxygen access to the at least part of the combustible heat sources wrapped in the oxygen-restricting combustion resistant wrapper. For example, combustible heat sources according to the invention may be wrapped in a substantially oxygen impermeable combustion resistant wrapper.

In such embodiments, the at least part of the combustible heat sources wrapped in the oxygen-restricting combustion resistant wrapper substantially lacks access to oxygen. Therefore, in such embodiments, the at least part of the combustible heat sources wrapped in the oxygen-restricting combustion resistant wrapper does not itself combust during the second stage of combustion of the combustible heat sources.

Preferably, combustible heat sources according to the invention are wrapped in a combustion resistant wrapper that is both heat-conducting and oxygen restricting.

Suitable combustion resistant wrappers for use in the invention include, but are not limited to: metal foil wrappers such as, for example, aluminium foil wrappers, steel foil wrappers, iron foil wrappers and copper foil wrappers; metal alloy foil wrappers; graphite foil wrappers; glass fibre wrappers; ceramic fibre wrappers; and certain paper wrappers.

Preferably, combustible heat sources according to the invention are substantially homogeneous in composition.

However, combustible heat sources according to the invention may alternatively be composite combustible heat sources.

Preferably, combustible heat sources according to the invention have a carbon content of at least about 35 percent, more preferably of at least about 40 percent, most preferably of at least about 45 percent by dry weight of the combustible heat source.

In some embodiments, combustible heat sources according to the invention may be combustible carbon-based heat sources.

As used herein, the term 'carbon-based heat source' is used to describe a heat source comprised primarily of carbon.

Combustible carbon-based heat sources according to the invention preferably have a carbon content of at least about 50 percent, more preferably of at least about 60 percent, most preferably of at least about 80 percent by dry weight of the combustible carbon-based heat source.

Preferably, combustible heat sources according to the invention have a porosity of between about 20% and about 80%, more preferably of between about 40% and 60%.

Combustible heat sources according to the invention preferably comprise at least one ignition aid that releases energy during ignition of the first portion of the combustible heat sources.

In such embodiments, the release of energy by the at least one ignition aid upon ignition of the first portion of the combustible heat sources directly causes a 'boost' in temperature during the first stage of combustion of the combustible heat sources. This is reflected in the temperature profile of the second portion of the combustible heat sources.

As stated above, as used herein the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts. As illustrated in FIG. 9, even when present in a large amount relative to the total weight of the combustible heat source, such alkali metal burn salts do not release enough energy during ignition of a combustible heat source to cause a 'boost' in temperature during the first stage of combustion of the combustible heat source.

Combustible heat sources according to the invention may comprise one or more ignition aids consisting of a single element or compound that release energy upon ignition of the first portion of the combustible heat sources. For example, in certain embodiments combustible heat sources according to the invention may comprise one or more energetic materials consisting of a single element or compound that reacts exothermically with oxygen upon ignition of the first portion of the combustible heat sources. Examples of suitable energetic materials include, but are not limited to, aluminium, iron, magnesium and zirconium.

Alternatively or in addition, combustible heat sources according to the invention may comprise one or more ignition aids comprising two or more elements or compounds that react with one another to release energy upon ignition of the first portion of the combustible heat sources. For example, in certain embodiments combustible heat sources according to the invention may comprise one or more thermites or thermite composites comprising a reducing agent such as, for example, a metal, and an oxidizing agent such as, for example, a metal oxide, that react with one another to release energy upon ignition of the first portion of the combustible heat sources. Examples of suitable metals include, but are not limited to, magnesium, and examples of suitable metal oxides include, but are not limited to, iron oxide ($Fe_2O_3$) and aluminium oxide ($Al_2O_3$)

In other embodiments, combustible heat sources according to the invention may comprise one or more ignition aids comprising other materials that undergo exothermic reactions upon ignition of the first portion of the combustible heat sources. Examples of suitable metals include, but are not limited to, intermetallic and bi-metallic materials, metal carbides and metal hydrides.

Combustible heat sources according to the invention preferably comprise at least one ignition aid that releases oxygen during ignition of the first portion of the combustible heat sources.

In such embodiments, the release of oxygen by the at least one ignition aid upon ignition of the first portion of the combustible heat sources indirectly results in a 'boost' in temperature during the first stage of combustion of the combustible heat sources by increasing the rate of combustion of the combustible heat sources. This is reflected in the temperature profile of the second portion of the combustible heat sources.

For example, combustible heat sources according to the invention may comprise one or more oxidizing agents that decompose to release oxygen upon ignition of the first portion of the combustible heat sources. Combustible heat sources according to the invention may comprise organic oxidizing agents, inorganic oxidizing agents or a combination thereof. Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

Alternatively or in addition, combustible heat sources according to the invention may comprise one or more oxygen storage or sequestering materials that release oxygen upon ignition of the first portion of the combustible heat sources. Combustible heat sources according to the invention may comprise oxygen storage or sequestering materials that store and release oxygen by means of encapsulation, physisorption, chemisorption, structural change or a combination thereof. Examples of suitable oxygen storage or sequestering materials include, but are not limited to: metal surfaces such as, for example, metallic silver or metallic gold surfaces; mixed metal oxides; molecular sieves; zeolites; metal-organic frameworks; covalent organic frameworks; spinels; and perovskites.

Combustible heat sources according to the invention may comprise one or more ignition aids consisting of a single element or compound that release oxygen upon ignition of the first portion of the combustible heat sources. Alternatively or in addition, combustible heat sources according to the invention may comprise one or more ignition aids comprising two or more elements or compounds that react with one another to release oxygen upon ignition of the first portions of the combustible heat source.

Combustible heat sources according to the invention may comprise one or more ignition aids that release both energy and oxygen upon ignition of the first portion of the combustible heat sources. For example, combustible heat sources according to the invention may comprise one or more oxidizing agents that decompose exothermically to release oxygen upon ignition of the first portion of the combustible heat sources.

Alternatively, or in addition, combustible heat sources according to the invention may comprise one or more first ignition aids that release energy upon ignition of the first portion of the combustible heat sources and one or more second ignition aids, which are different to the one or more first ignition aids, that release oxygen upon ignition of the first portion of the combustible heat sources.

In one embodiment, combustible heat sources according to the invention comprise at least one metal nitrate salt having a thermal decomposition temperature of less than about 600° C., more preferably of less than about 400° C.

Preferably, the at least one metal nitrate salt has a decomposition temperature of between about 150° C. and about 600° C., more preferably of between about 200° C. and about 400° C.

In such embodiments, when the first portion of the combustible heat sources is exposed to a conventional yellow flame lighter or other ignition means, the at least one metal nitrate salt decomposes to release oxygen and energy. This causes an initial boost in the temperature of the combustible heat sources and also aids in the ignition of the combustible heat sources. Following total decomposition of the at least one metal nitrate salt, the combustible heat sources continue to combust at a lower temperature.

The inclusion of at least one metal nitrate salt advantageously results in ignition of the combustible heat sources being initiated internally, and not only at a point on the surface thereof. Preferably, the at least one metal nitrate salt is distributed substantially homogeneously throughout the combustible heat sources.

As previously explained above, in use the boost in temperature of the combustible heat sources upon ignition of the first portion thereof resulting from the decomposition of the at least one metal nitrate salt is reflected in the increase in temperature of the second portion of the combustible heat sources to the first 'boost' temperature. In use in smoking articles according to the invention, this advantageously ensures that sufficient heat is transferred from the combustible heat sources to the aerosol forming material of the smoking articles to produce an acceptable aerosol during early puffs thereof.

As also previously explained above, the subsequent decrease in temperature of the combustible heat sources following the decomposition of the at least one metal nitrate salt is also reflected in the subsequent decrease in temperature of the second portion of the combustible heat sources to the second 'cruising' temperature. In use in smoking articles according to the invention, this advantageously ensures that the aerosol-generating substrate of the smoking articles is not thermally degraded or combusted.

The magnitude and duration of the boost in temperature resulting from the decomposition of the at least one metal nitrate salt may be advantageously controlled through the nature and amount of the at least one metal nitrate salt in the combustible heat sources.

Preferably, the at least one metal nitrate salt is present in the combustible heat sources in an amount of between about 20 percent and about 50 percent by dry weight of the combustible heat sources.

Preferably, the at least one metal nitrate salt is selected from the group consisting of potassium nitrate, sodium nitrate, calcium nitrate, strontium nitrate, barium nitrate, lithium nitrate, aluminium nitrate and iron nitrate.

Preferably, combustible heat sources according to the invention comprise at least two different metal nitrate salts.

In one embodiment, combustible heat sources according to the invention comprise potassium nitrate, calcium nitrate and strontium nitrate. Preferably, the potassium nitrate is present in an amount of between about 5 percent and about 15 percent by dry weight of the combustible heat sources, the calcium nitrate is present in an amount of between about 2 percent and about 10 percent by dry weight of the combustible heat sources and the strontium nitrate is present in an amount of between about 15 percent by weight and about 25 percent by dry weight of the combustible heat sources.

In another embodiment, combustible heat sources according to the invention comprise at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably of between about 200° C. and about 400° C., most preferably at a temperature of about 350° C.

In use, when the first portion of the combustible heat sources is exposed to a conventional yellow flame lighter or other ignition means, the at least one peroxide or superoxide decomposes to release oxygen. This causes an initial boost in the temperature of the combustible heat sources and also aids in the ignition of the combustible heat sources. Following total decomposition of the at least one peroxide or superoxide, the combustible heat sources continue to combust at a lower temperature.

The inclusion of at least one peroxide or superoxide advantageously results in ignition of the combustible heat sources being initiated internally, and not only at a point on the surface thereof. Preferably, the at least one peroxide or superoxide is distributed substantially homogeneously throughout the combustible heat sources.

As previously explained above, in use the boost in temperature of the combustible heat sources upon ignition of the first portion thereof resulting from the decomposition of the at least one peroxide or superoxide is reflected in the increase in temperature of the second portion of the combustible heat sources to the first 'boost' temperature. In use in smoking articles according to the invention, this advantageously ensures that sufficient heat is transferred from the combustible heat sources to the aerosol forming material of the smoking articles according to the invention to produce an acceptable aerosol during early puffs thereof.

As also previously explained above, the subsequent decrease in temperature of the combustible heat sources following the decomposition of the at least one peroxide or superoxide is also reflected in the subsequent decrease in temperature of the second portion of the combustible heat sources to the second 'cruising' temperature. In use in smoking articles according to the invention, this advantageously ensures that the aerosol-generating substrate of the smoking articles is not thermally degraded or combusted.

The magnitude and duration of the boost in temperature resulting from the decomposition of the at least one peroxide or superoxide may be advantageously controlled through the nature and amount of the at least one peroxide in the combustible heat sources.

The at least one peroxide or superoxide is preferably present in the combustible heat sources in an amount of between about 20 percent and about 50 percent by dry weight of the combustible heat sources, more preferably in an amount of between about 30 percent and about 50 percent by dry weight of the combustible heat sources.

Suitable peroxides and superoxides for inclusion in combustible heat sources according to the invention include, but are not limited to, calcium peroxide, strontium peroxide, magnesium peroxide, barium peroxide, lithium peroxide, zinc peroxide, potassium superoxide and sodium superoxide.

Preferably, the at least one peroxide is selected from the group consisting of calcium peroxide, strontium peroxide, magnesium peroxide, barium peroxide and combinations thereof. The inclusion of at least one peroxide or superoxide is particularly preferred where combustible heat sources according to the invention are combustible carbon-based heat sources.

Combustible heat sources according to the invention may be formed from one or more suitable carbon-containing materials. Suitable carbon-containing materials are well known in the art and include, but are not limited to, carbon powder.

If desired, one or more binders may be combined with the one or more carbon containing materials. The one or more binders may be organic binders, inorganic binders or a combination thereof. Suitable known organic binders include but are not limited to: gums such as, for example, guar gum; modified celluloses and cellulose derivatives such as, for example, methyl cellulose, carboxymethyl cellulose, hydroxypropyl cellulose and hydroxypropyl methylcellulose; wheat flour; starches; sugars; vegetable oils; and combinations thereof.

Suitable known inorganic binders include, but are not limited to: clays such as, for example, bentonite and kaolinite; alumino-silicate derivatives such, for example, as cement, alkali activated alumino-silicates; alkali silicates such as, for example, sodium silicates and potassium silicates; limestone derivatives such as, for example, lime and hydrated lime; alkaline earth compounds and derivatives such as, for example, magnesia cement, magnesium sulfate, calcium sulfate, calcium phosphate and dicalcium phosphate; and aluminium compounds and derivatives such as, for example, aluminium sulphate.

In one embodiment, combustible heat sources according to the invention are formed from a mixture of: carbon powder; modified cellulose, such as, for example, carboxymethyl cellulose; flour such as, for example, wheat flour; and sugar such as, for example, white crystalline sugar derived from beet.

In another embodiment, combustible heat sources according to the invention are formed from a mixture of carbon powder, modified cellulose, such as, for example, carboxymethyl cellulose; and optionally bentonite.

Instead of, or in addition to one or more binders, other additives may also be combined with the one or more carbon containing materials in order to improve the properties of the combustible heat sources. Suitable additives include, but are not limited to, additives to promote consolidation of the combustible heat sources (for example, sintering aids, such as calcium carbonate), additives to promote combustion of the combustible heat sources (for example, potassium and, alkali metal burn salts, for example potassium salts, such as potassium chloride and potassium citrate) and additives to promote decomposition of one or more gases produced by combustion of the combustible heat sources, for example catalysts, such as copper oxide (CuO), iron oxide ($Fe_2O_3$), iron oxide silicate powder and aluminium oxide ($Al_2O_3$).

The one or more carbon containing materials are preferably mixed with the one or more binders and other additives, where included, and pre-formed into a desired shape. The mixture of one or more carbon containing materials, one or more binders and other additives may be pre-formed into a desired shape using any suitable known ceramic forming methods such as, for example, slip casting, extrusion, injection moulding and die compaction or pressing. Preferably, the mixture is pre-formed into a desired shape by pressing or extrusion.

Preferably, the mixture of one or more carbon containing materials, one or more binders and other additives is pre-formed into a cylindrical rod. However, it will be appreciated that the mixture of one or more carbon containing materials, one or more binders and other additives may be pre-formed into other desired shapes.

After formation, the cylindrical rod or other desired shape is preferably dried to reduce its moisture content.

In a first embodiment of the heat source production process, the dried cylindrical rod is pyrolysed in a non-oxidizing atmosphere at a temperature sufficient to carbonise the one or more binders, where present, and substantially eliminate any volatiles in the cylindrical rod or other shape. Preferably, the cylindrical rod or other desired shape is pyrolysed in a nitrogen atmosphere at a temperature of between about 700° C. and about 900° C. At least one metal nitrate salt may be incorporated in combustible heat sources according to the invention by including at least one metal nitrate precursor in the mixture of one or more carbon containing materials, one or more binders and other additives and then subsequently converting the at least one metal nitrate precursor into at least one metal nitrate salt in-situ, by treating the pyrolysed pre-formed cylindrical rod or other shape with an aqueous solution of nitric acid.

The at least one metal nitrate precursor may be any metal or metal-containing compound such as, for example, metal oxide or metal carbonate, that reacts with nitric acid to form a metal nitrate salt. Suitable metal nitrate salt precursors include, but are not limited to calcium carbonate, potassium carbonate, calcium oxide, strontium carbonate, lithium carbonate and dolomite (calcium magnesium carbonate).

Preferably, the concentration of the aqueous solution of nitric acid is between about 20 percent and about 50 percent by weight, more preferably of between about 30 percent and about 40 percent by weight. As well as converting the at least one metal nitrate precursor to at least one metal nitrate salt, treatment of combustible heat sources according to the invention with nitric acid advantageously enhances the porosity of the combustible heat sources, activates the carbon structure by increasing the surface area thereof and results in a substantially homogeneous distribution of the at least one metal nitrate salt throughout the combustible heat sources.

The aqueous solution of nitric acid may further comprise one or more water-soluble metal nitrate salts having a thermal decomposition temperature of less than about 400° C. For example, the aqueous solution of nitric acid may further comprise potassium nitrate. As well as converting the at least one metal nitrate precursor to at least one metal nitrate salt, treatment of combustible heat sources according to the invention with nitric acid comprising one or more substantially water-soluble metal nitrate salts advantageously infiltrates the combustible heat sources with the one or more substantially water-soluble nitrates.

Alternatively or in addition, at least one metal nitrate salt may be incorporated in combustible heat sources according to the invention by directly infiltrating the pyrolysed preformed shape with a solution comprising the at least one metal nitrate salt.

Preferably, combustible heat sources according to the invention are infiltrated with an aqueous solution of the at least one metal nitrate salt. In a particularly preferred embodiment of the invention, combustible heat sources according to the invention are infiltrated with an aqueous solution comprising potassium nitrate, calcium nitrate and strontium nitrate.

Combustible heat sources according to the invention are preferably infiltrated with aqueous solutions comprising at least one metal nitrate salt. Preferably, the at least one metal nitrate salt has a solubility in water of at least about 30 g/100 mL at 25° C.

However, it will be appreciated that combustible heat sources according to the invention may alternatively be infiltrated with non-aqueous solutions comprising at least one metal nitrate salt.

In a second embodiment of the heat source production process, the one or more carbon containing materials, one or more binders, other additives and at least one ignition aid are mixed and formed into a desired shape by, for example, pressing or extrusion, without a pyrolisation step. This method is preferably used where the at least one ignition aid comprises one or materials selected from the group consisting of peroxides, thermites, intermetallics, magnesium, aluminium and zirconium.

Preferably, combustible heat sources according to the invention have a mass of between about 300 mg and about 500 mg, more preferably of between about 400 mg and about 450 mg prior to infiltration with a solution comprising the at least one metal nitrate salt.

The porosity of combustible heat sources has a substantial impact on their ignition and combustion properties. Combustible heat sources according to the invention preferably have a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds.

The required porosity may be readily achieved during production of combustible heat sources according to the invention using conventional methods and technology, and may be measured by Hg-porosimetry and He-pycnometry in a known manner.

For example, combustible heat sources according to the invention having a porosity of between about 20 percent and about 80 percent may be prepared by pyrolysis of a mixture comprising a carbon-containing material and one or more suitable known pore formers. Suitable known pore formers include, but are not limited to, corn, cellulose flakes, stearate, carbonates, polyethylene and polypropylene beads, wood pellets and cork.

Alternatively or in addition, combustible heat sources according to the invention may be treated with an acid in order to achieve a desired porosity.

Advantageously, combustible heat sources according to the invention have an apparent density of between about 0.6 $g/cm^3$ and about 1.0 $g/cm^3$.

Combustible heat sources according to the invention may be 'blind' combustible heat sources. As used herein, the term 'blind combustible heat source' is used to denote a combustible heat source that does not contain any longitudinal airflow channels. As used herein, the term 'longitudinal airflow channel' is used to denote a hole passing through an inner portion of the combustible heat source and extending along the entire length of the combustible heat source.

Alternatively, combustible heat sources according to the invention may comprise at least one longitudinal airflow channel. For example, combustible heat sources according to the invention comprise one, two or three longitudinal airflow channels. In such embodiments, combustible heat sources according to the invention preferably comprise a single longitudinal airflow channel, more preferably a single substantially central longitudinal airflow channel. The diameter of the single longitudinal airflow channel is preferably between about 1.5 mm and about 3 mm.

The inner surface of the at least one longitudinal airflow channel of combustible heat sources according to the invention may be partially or entirely coated. Preferably, the coating covers the inner surface of all longitudinal airflow channels.

Preferably, the coating comprises a layer of solid particulate matter and is substantially air impermeable. Advantageously, the substantially air impermeable coating is of low thermal conductivity. The coating may be formed from one or more suitable materials that are substantially thermally stable and non-combustible at the combustion temperature of the combustible heat sources. Suitable materials are known in the art and include, for example, clays, metal oxides, such as iron oxide, alumina, titania, silica, silica-alumina, zirconia and ceria, zeolites, zirconium phosphate and other ceramic materials or combinations thereof. Preferred coating materials include clays, glasses and iron oxide. If desired, catalytic ingredients, such as ingredients that promote the oxidation of carbon monoxide to carbon dioxide, may be incorporated in the coating material. Suitable catalytic ingredients include, for example, platinum, palladium, transition metals and their oxides.

Preferably, the coating has a thickness of between about 30 microns and about 200 microns, more preferably of between about 50 microns and about 150 microns.

The coating may be applied to the inner surface of the at least one longitudinal airflow channel of the combustible heat sources by any suitable method, such as the methods described in U.S. Pat. No. 5,040,551. For example, the inner surface of each longitudinal airflow channel may be sprayed, wetted or painted with a solution or a suspension of the coating. Alternatively, the coating may be provided by insertion of a liner into one or more longitudinal airflow channels. For example, a substantially air impermeable hollow tube may be inserted into each longitudinal airflow channel.

In one embodiment, the coating is applied to the inner surface of the at least one longitudinal airflow channel of the combustible heat sources by the process described in WO-A2-2009/074870 as the combustible heat sources are extruded.

Optionally, combustible heat sources according to the invention may comprise one or more, preferably up to and including six, longitudinal grooves that extend along part of or the entire periphery of the combustible heat sources. If desired, combustible heat sources according to the invention may comprise one or more longitudinal grooves and at least one longitudinal airflow channel. Alternatively, combustible heat sources according to the invention may be blind combustible heat sources comprising one or more longitudinal grooves.

Combustible heat sources according to the invention are particularly suited for use in smoking articles of the type disclosed in WO-A-2009/022232. However, it will be appreciated that combustible heat sources according to the invention may also be used in smoking articles having different constructions.

Smoking articles according to the invention may comprise a combustible heat source according to the invention and an aerosol-generating substrate located immediately downstream of the combustible heat source. In such embodiments, the aerosol-generating substrate may abut the second portion of the combustible heat source.

Alternatively, smoking articles according to the invention may comprise a combustible heat source according to the invention and an aerosol-generating substrate located downstream of the combustible heat source, wherein the aerosol-generating substrate is spaced apart from the combustible heat source.

Preferably, smoking articles according to the invention comprise a combustible heat source according to the invention wrapped in a heat-conducting and oxygen-restricting combustion resistant wrapper.

Preferably, at least a rear part of the combustible heat source of smoking articles according to the invention is wrapped in the combustion resistant wrapper.

Smoking articles according to the invention may comprise a combustible heat source according to the invention that is wrapped in a combustion resistant wrapper along substantially its entire length.

However, preferably only a rear part of the combustible heat source of smoking articles according to the invention is wrapped in the combustion resistant wrapper, such that a front part of the combustible heat source is not wrapped in the combustion resistant wrapper.

Preferably, the front part of the combustible heat source not wrapped in the combustion resistant wrapper is between about 4 mm and about 15 mm in length, more preferably between about 4 mm and about 8 mm in length.

Preferably, the rear part of the combustible heat source wrapped in the combustion resistant wrapper is between about 2 mm and about 8 mm in length, more preferably between about 3 mm and about 5 mm in length.

Preferably, at least a rear part of the combustible heat source and at least a front part of the aerosol-generating substrate of smoking articles according to the invention are wrapped in the combustion resistant wrapper. In such embodiments, the combustion resistant wrapper is around and in direct contact with the periphery of at least a rear part of the combustible heat source and the periphery of at least a front part of the aerosol-generating substrate of the smoking articles. As previously described above, where the combustion resistant wrapper is heat-conducting, the combustion resistant wrapper thus provides a thermal link between these two components of the smoking articles.

At least a rear part of the combustible heat source and the entire aerosol-generating substrate of smoking articles according to the invention may be wrapped in the combustion resistant wrapper.

However, preferably only a front part of the aerosol-generating substrate of smoking articles according to the invention is wrapped in the combustion resistant wrapper, such that a rear part of the aerosol-generating substrate is not wrapped in the combustion resistant wrapper.

Preferably, the rear part of the aerosol-generating substrate not wrapped in the combustion resistant wrapper is at least about 3 mm in length. In other words, the aerosol-generating substrate preferably extends at least about 3 mm downstream beyond the combustion resistant wrapper.

Preferably, the aerosol-generating substrate has a length of between about 5 mm and about 20 mm, more preferably of between about 8 mm and about 12 mm. Preferably, the front part of the aerosol-generating substrate wrapped in the combustion resistant wrapper is between about 2 mm and about 10 mm in length, more preferably between about 3 mm and about 8 mm in length, most preferably between about 4 mm and about 6 mm in length. Preferably, the rear part of the aerosol-generating substrate not wrapped in the combustion resistant wrapper is between about 3 mm and about 10 mm in length. In other words, the aerosol-generating substrate preferably extends between about 3 mm and about 10 mm downstream beyond the combustion resistant wrapper. More preferably, the aerosol-generating substrate extends at least about 4 mm downstream beyond the combustion resistant wrapper.

Preferably, the aerosol-generating substrate of smoking articles according to the invention comprises at least one aerosol former and a material capable of emitting volatile compounds in response to heating. The aerosol may be visible or invisible and includes vapours as well as gases and liquid droplets of condensed vapours.

The at least one aerosol former may be any suitable known compound or mixture of compounds that, in use, facilitates formation of a dense and stable aerosol and that is substantially resistant to thermal degradation at the operating temperature. Suitable aerosol formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

Preferably, the material capable of emitting volatile compounds in response to heating is a charge of plant-based material, more preferably a charge of homogenised plant-based material. For example, the aerosol-generating substrate may comprise one or more materials derived from plants including, but not limited to, tobacco, tea, for example green tea, peppermint, laurel, eucalyptus, basil, sage, verbena and tarragon. The plant based-material may comprise additives including, but not limited to, humectants, flavourants, binders and mixtures thereof. Preferably, the plant-based material consists essentially of tobacco material, most preferably homogenised tobacco material.

Smoking articles according to the invention preferably further comprise an expansion chamber downstream of the aerosol-generating substrate. The inclusion of an expansion chamber advantageously allows further cooling of the aerosol generated by heat transfer from the combustible heat source to the aerosol-generating substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may also further comprise a mouthpiece downstream of the aerosol-generating substrate and, where present, downstream of the expansion chamber. The mouthpiece may, for example, comprise a filter having one or more segments. The filter may comprise one or more segments of cellulose acetate, paper or other suitable known filtration materials. Preferably, the integral mouthpiece is of low filtration efficiency, more preferably of very low filtration efficiency. Alternatively or in addition, the filter may comprise one or more segments comprising absorbents, adsorbents, flavourants, and other aerosol modifiers and additives used in filters for conventional cigarettes, or combinations thereof.

If desired, ventilation may be provided at a location downstream of the combustible heat source of smoking articles according to the invention. For example, where present, ventilation may be provided at a location along the integral mouthpiece of smoking articles according to the invention.

Smoking articles according to the invention may be assembled using known methods and machinery.

The invention will be further described, by way of example only, with reference to the accompanying drawings in which:

FIG. 1 shows a schematic longitudinal cross-section of a smoking article according to the invention;

FIG. 2*a* shows a graph of the temperature of the downstream end of the combustible heat source of a smoking article according to a first embodiment of the invention upon ignition of the upstream end thereof.

FIG. 2*b* shows a graph of the temperature of the downstream end of the combustible heat source of the smoking article according to the first embodiment of the invention during subsequent combustion of the combustible heat source;

FIG. 3*a* shows a graph of the temperature of the aerosol-generating substrate of the smoking article according to the first embodiment of the invention during combustion of the combustible heat source thereof;

FIG. 3*b* shows a graph of the absorbance at 320 nm of the aerosol generated by the smoking article according to the first embodiment of the invention as a function of puff number;

FIG. 4*a* shows a graph of the temperature of the downstream end of the combustible heat source of a smoking article according to a second embodiment of the invention upon ignition of the upstream end thereof;

FIG. 4*b* shows a graph of the temperature of the downstream end of the combustible heat source of the smoking article according to the second embodiment of the invention during subsequent combustion of the combustible heat source;

FIG. 5*a* shows a graph of the temperature of the aerosol-generating substrate of the smoking article according to the second embodiment of the invention;

FIG. 5*b* shows a graph of the absorbance at 320 nm of the aerosol generated by the smoking article according to the second embodiment of the invention as a function of puff number;

FIG. 6*a* shows a plan view of the upstream end of the combustible heat source of a smoking article according to a third embodiment of the invention; and FIG. 6*b* shows a longitudinal cross-section of the combustible heat source of a smoking article according to a third embodiment of the invention;

Figure 9A:
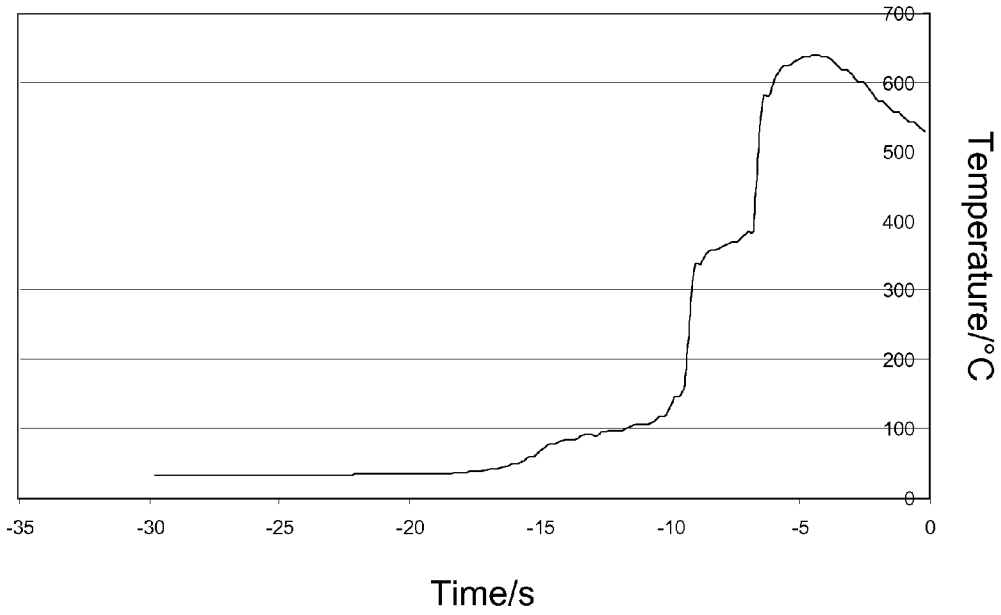
Figure 9B:
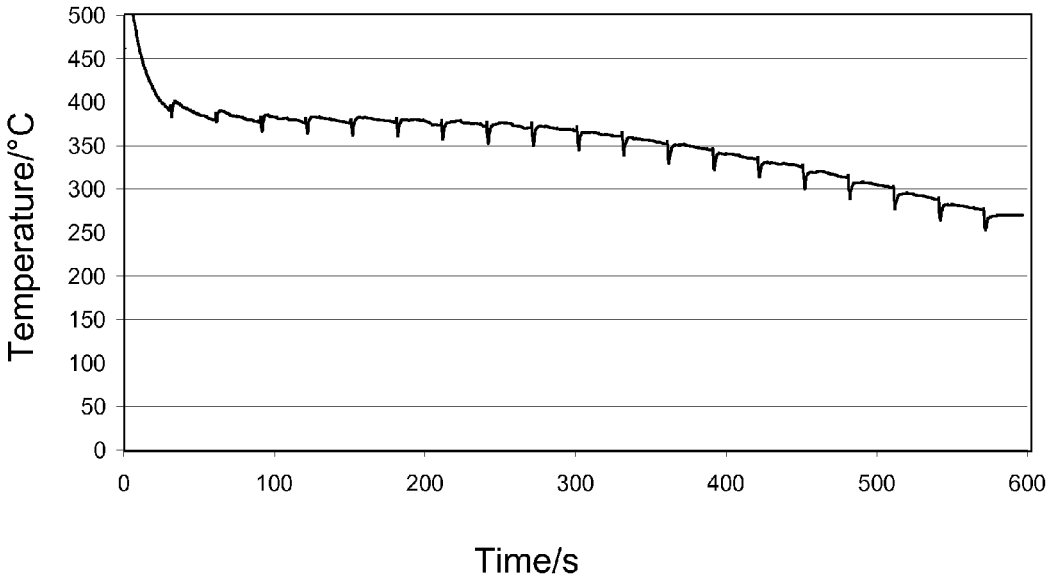
Figure 10:
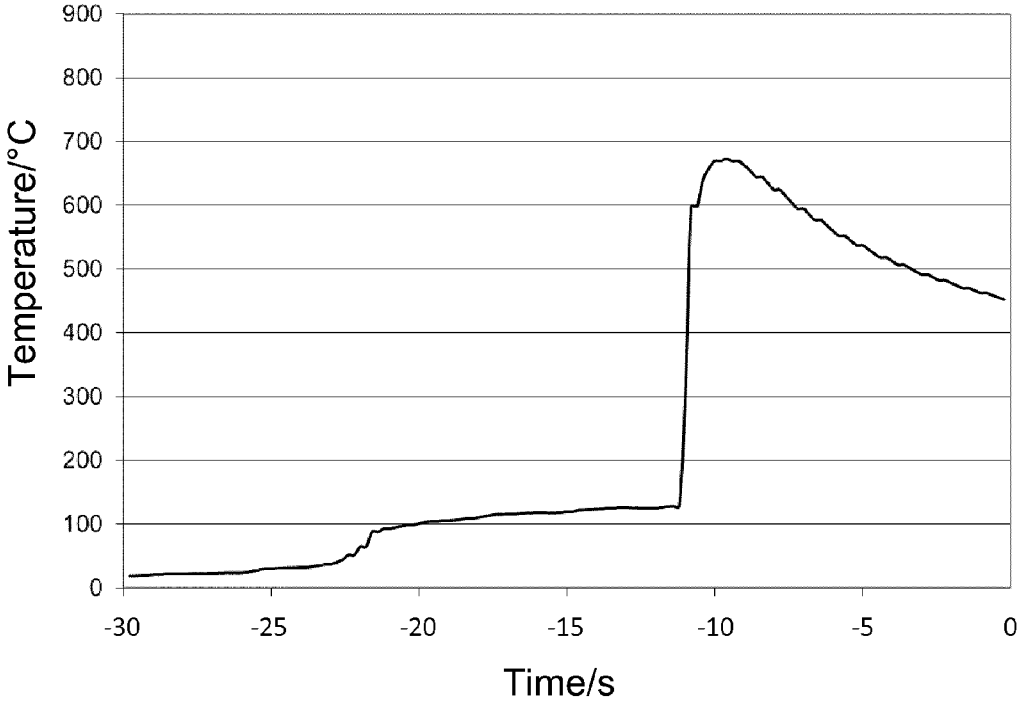
Figure 11:
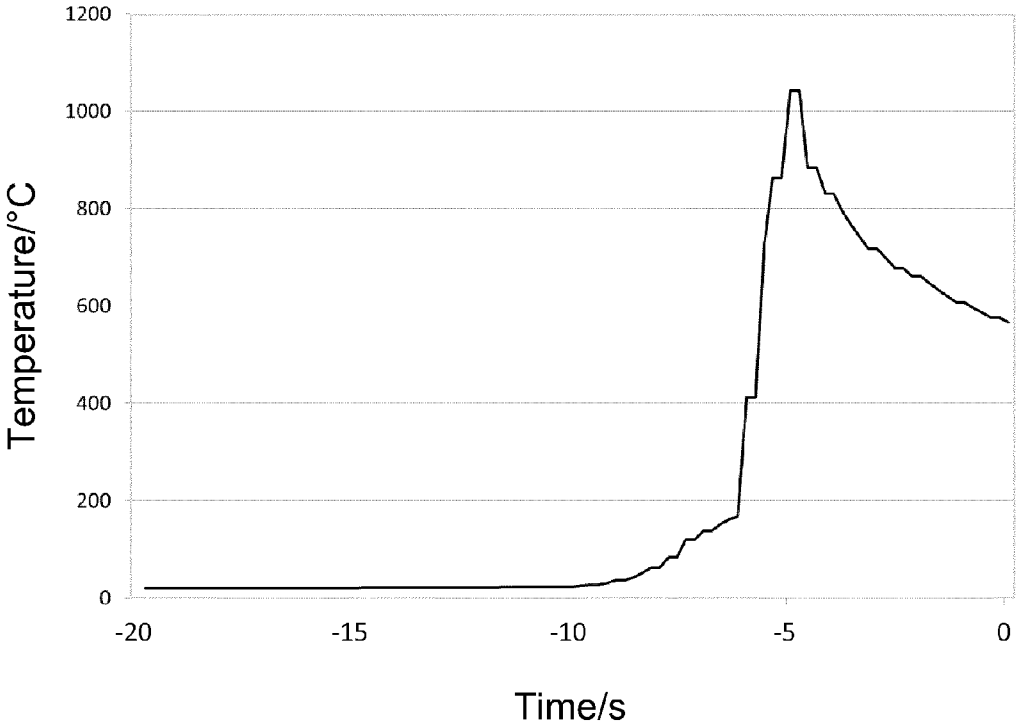
Figure 12:
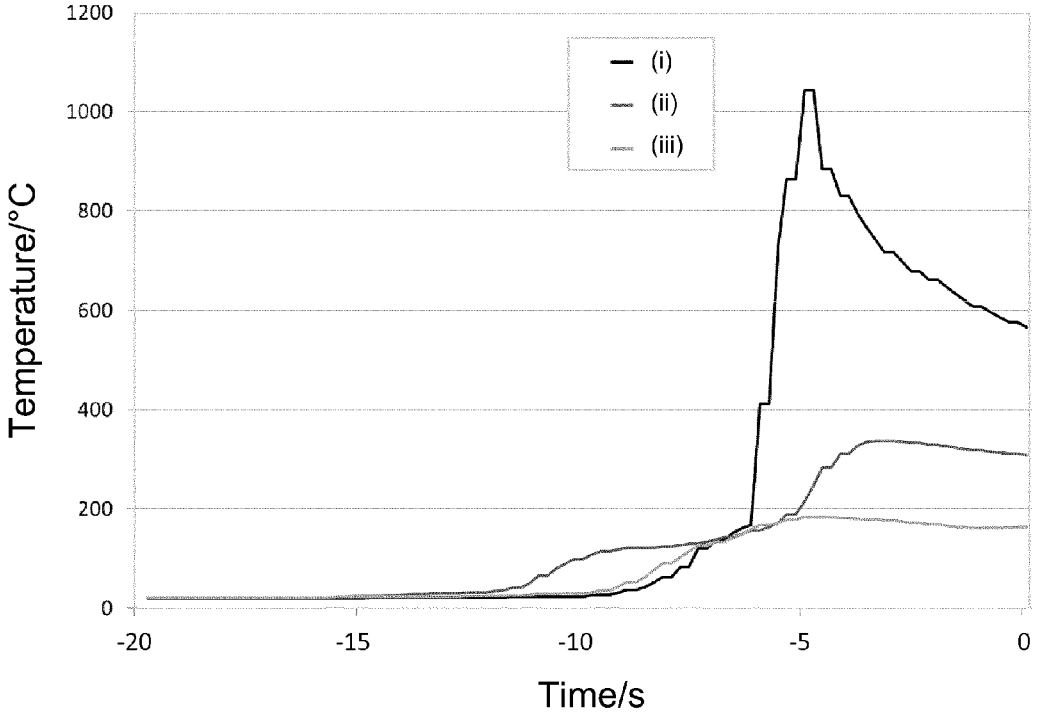
Figure 13:
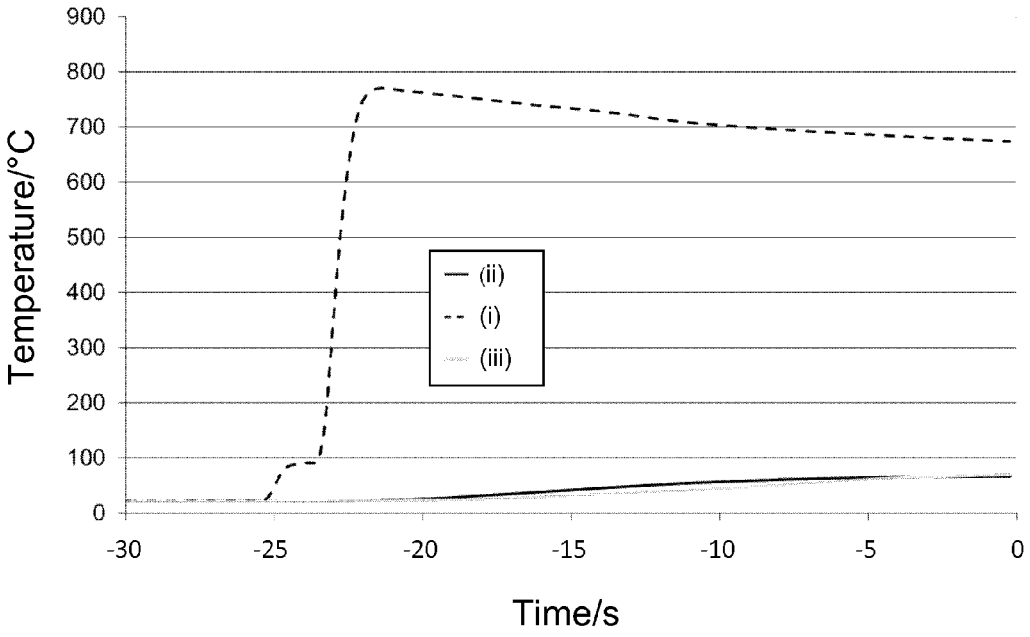

FIG. 9*a* shows a graph of the temperature of the downstream end of the combustible heat source of a smoking article according to a seventh embodiment of the invention upon ignition of the upstream end thereof;

FIG. 9*b* shows a graph of the temperature of the downstream end of the combustible heat source of the smoking article according to the seventh embodiment of the invention during subsequent combustion of the combustible heat source;

FIG. 10 shows a graph of the temperature of the downstream end of the combustible heat source of a smoking article according to an eighth embodiment of the invention upon ignition of the upstream end thereof;

FIG. 11 shows a graph of the temperature of the downstream end of the combustible heat source of a smoking article according to a ninth embodiment of the invention upon ignition of the upstream end thereof; and FIG. 12 shows a graph of the combustible heat sources of: (i) a smoking article according to the ninth embodiment of the invention; (ii) a third comparative smoking article; and (iii) a fourth comparative smoking article upon ignition of the upstream ends thereof; and FIG. 13 shows a graph of the combustible heat sources of: (i) a smoking article according to the fourth embodiment of the invention; (ii) a fifth comparative smoking article; and (iii) a sixth comparative smoking article upon ignition of the upstream ends thereof.

In the graphs of FIGS. 2*a*, 2*b*, 3*a*, 4*a*, 4*b*, 5*a*, 7, 8, 9*a*, 9*b*, 10, 11, 12 and 13 time zero indicates the time of the first puff.

Figure 1:
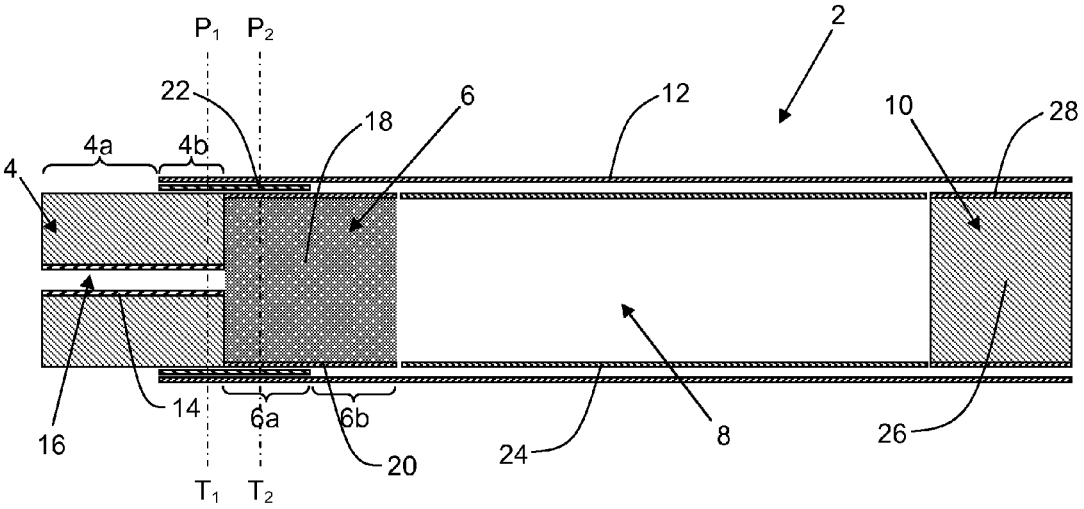

The smoking article 2 shown in FIG. 1 has an overall length of 70 mm, a diameter of 7.9 mm and comprises a combustible heat source 4 according to the invention, an aerosol-generating substrate 6, an elongate expansion chamber 8 and a mouthpiece 10. As shown in FIG. 1, the combustible heat source 4, aerosol-generating substrate 6, elongate expansion chamber 8 and mouthpiece are in abutting coaxial alignment and are overwrapped in an outer wrapper of cigarette paper 12 of low air permeability.

The combustible heat-source 4 is 11 mm in length and 7.8 mm in diameter and comprises a central airflow channel 16 of circular cross-section that extends longitudinally through the combustible heat source 4. A substantially air impermeable, heat resistant, partially sintered glass coating 14 having a thickness of 80 microns is provided on the inner surface of the central airflow channel 16, which is 2 mm in diameter.

The aerosol-generating substrate 6, which is 10 mm in length and 7.8 mm in diameter and has density of 0.8 g/cm$^3$, is located immediately downstream of the combustible heat source 4. The aerosol-generating substrate 6 comprises a cylindrical plug of homogenised tobacco material 18 comprising glycerine as an aerosol former and circumscribed by filter plug wrap 20. The homogenised tobacco material 18 consists of longitudinally aligned filaments of extruded tobacco material.

A combustion resistant wrapper 22 consisting of a tube of aluminium foil having a thickness of 20 microns, a length of 9 mm and a diameter of 7.8 mm surrounds and is in contact with a rear part 4*b* of the combustible heat source 4 of 4 mm in length and an abutting front part 6*a* of the aerosol-generating substrate 6 of 5 mm in length. As shown in FIG. 1, a front part 4*a* of the combustible heat source 4 of 7 mm in length and a rear part 6*b* of the aerosol-generating substrate 6 of 5 mm in length are not surrounded by the combustion resistant wrapper 22.

The elongate expansion chamber 8, which is 42 mm in length and 7.8 mm in diameter, is located downstream of the aerosol-generating substrate 6 and comprises a cylindrical open-ended tube of cardboard 24. The mouthpiece 10 of the smoking article 2, which is 7 mm in length and 7.8 mm in diameter, is located downstream of the expansion chamber 8 and comprises a cylindrical plug of cellulose acetate tow 26 of very low filtration efficiency circumscribed by filter plug wrap 28. The mouthpiece 10 may be circumscribed by tipping paper (not shown).

In use, the consumer ignites the combustible heat source 4 and then draws air through the central airflow channel 16 downstream towards the mouthpiece 10. The front part 6*a* of the aerosol-generating substrate 6 is heated primarily by conduction through the abutting non-combusting rear part 4*b* of the combustible heat source 4 and the combustion resistant wrapper 22. The drawn air is heated as it passes through the central airflow channel 16 and then heats the aerosol-generating substrate 6 by convection. The heating of the aerosol-generating substrate 6 releases volatile and semi-volatile compounds including the aerosol former from the aerosol-generating substrate 18, which are entrained in the heated drawn air as it flows through the aerosol-generating substrate. The heated air and entrained compounds pass downstream through the expansion chamber 8, cool and condense to form an aerosol that passes through the mouthpiece into the mouth of the consumer at about ambient temperature.

To make the smoking article 2, a rectangular piece of the combustion resistant wrapper 22 is glued to cigarette paper 12. The combustible heat source 4, the plug of the aerosol-generating substrate 6 and the expansion chamber 8 are suitably aligned and positioned on the cigarette paper 12 with the attached combustion resistant wrapper 22. The cigarette paper 12 with the attached combustion resistant wrapper 22 is wrapped around the rear part 4*b* of the combustible heat source 4, the aerosol-generating substrate 6 and the expansion chamber 8 and glued. The mouthpiece 10 is attached to the open end of the expansion chamber using known filter combining technology.

Smoking articles according to a first embodiment of the invention having the structure shown in FIG. 1 and described above were assembled using combustible heat sources according to a first embodiment of the invention produced in accordance with Example 1.

Smoking articles according to a second embodiment of the invention having the structure shown in FIG. 1 and described above were assembled using combustible heat sources according to a second embodiment of the invention produced in accordance with Example 2.

Smoking articles according to a third embodiment of the invention having the structure shown in FIG. 1 and described above were assembled using combustible heat sources according to a third embodiment of the invention produced in accordance with Example 3.

Smoking articles according to a fourth embodiment of the invention having the structure shown in FIG. 1 and described above were assembled using combustible heat sources according to a fourth embodiment of the invention produced in accordance with Example 4.

Smoking articles according to a fifth embodiment of the invention having the structure shown in FIG. 1 and described above were assembled using combustible heat sources according to a fifth embodiment of the invention produced in accordance with Example 5.

Smoking articles according to a sixth embodiment of the invention having the structure shown in FIG. 1 and described above were assembled using combustible heat sources according to a fifth embodiment of the invention produced in accordance with Example 5.

First comparative smoking articles having the structure shown in FIG. 1 and described above were assembled using first comparative combustible heat sources produced in accordance with Example 5.

Second comparative smoking articles having the structure shown in FIG. 1 and described above were assembled using second comparative combustible heat sources produced in accordance with Example 5.

Smoking articles according to a seventh embodiment of the invention having the structure shown in FIG. 1 and described above were assembled using combustible heat sources according to a seventh embodiment of the invention produced in accordance with Example 6.

Smoking articles according to an eighth embodiment of the invention having the structure shown in FIG. 1 and described above were assembled using combustible heat sources according to an eighth embodiment of the invention produced in accordance with Example 7.

Smoking articles according to a ninth embodiment of the invention having the structure shown in FIG. 1 and described above were assembled using combustible heat sources according to a ninth embodiment of the invention produced in accordance with Example 8.

Third comparative smoking articles having the structure shown in FIG. 1 and described above were assembled using third comparative combustible heat sources produced in accordance with Example 9.

Fourth comparative smoking articles having the structure shown in FIG. 1 and described above were assembled using fourth comparative combustible heat sources produced in accordance with Example 9.

Fifth comparative smoking articles having the structure shown in FIG. 1 and described above were assembled using fifth comparative combustible heat sources produced in accordance with Example 10.

Sixth comparative smoking articles having the structure shown in FIG. 1 and described above were assembled using sixth comparative combustible heat sources produced in accordance with Example 10.

EXAMPLE 1

Combustible heat sources according to a first embodiment of the invention were prepared by mixing 525 g of carbon powder, 225 g of calcium carbonate ($CaCO_3$), 51.75 g of potassium citrate, 84 g of modified cellulose, 276 g of flour, 141.75 g of sugar and 21 g of corn oil with 579 g of deionised water to form an aqueous slurry.

The aqueous slurry was then extruded through a die having a central die orifice of circular cross-section with a diameter of 8.7 mm to form cylindrical rods having a length of about 20-22 cm and a diameter of about 9.1-9.2 mm. A single longitudinal air flow passageway was formed in the cylindrical rods by a mandrel of circular cross-section with an outer diameter of approximately 2 mm mounted centrally in the die orifice. During extrusion of the cylindrical rods, a glass coating slurry was pumped through a feed passageway extending through the centre of the mandrel to form a thin coating of about 150-300 microns on the inner surface of the single longitudinal airflow passageway.

The cylindrical rods were dried at about 20-25° C., 40-50 percent relative humidity, for between about 12 hours and about 72 hours and then pyrolysed in a nitrogen atmosphere at 750° C. for about 240 minutes.

After pyrolysis, the cylindrical rods were cut and shaped to a defined diameter using a grinding machine to form individual combustible heat sources having a length of about 11 mm, a diameter of about 7.8 mm and a dry mass of about 400 mg.

The individual combustible heat sources were dried at 130° C. for approximately 1 hour and then placed in an aqueous solution of nitric acid having a concentration of 38 percent by weight, which was saturated with potassium nitrate ($KNO_3$).

After approximately 5 minutes, the individual combustible heat sources were removed from the solution and dried at 130° C. for approximately 1 hour.

After drying the individual combustible heat sources were placed once again in an aqueous solution of nitric acid having a concentration of 38 percent by weight, which was saturated with potassium nitrate ($KNO_3$).

After approximately 5 minutes, the individual combustible heat sources were removed from the solution and dried at 130° C. for approximately 1 hour, then at 160° C. for approximately 1 hour and finally at 200° C. for approximately 1 hour.

The dried individual combustible heat sources had an ignition aid (potassium nitrate) content of about 39 percent by dry weight of the combustible heat source.

Figure 2A:
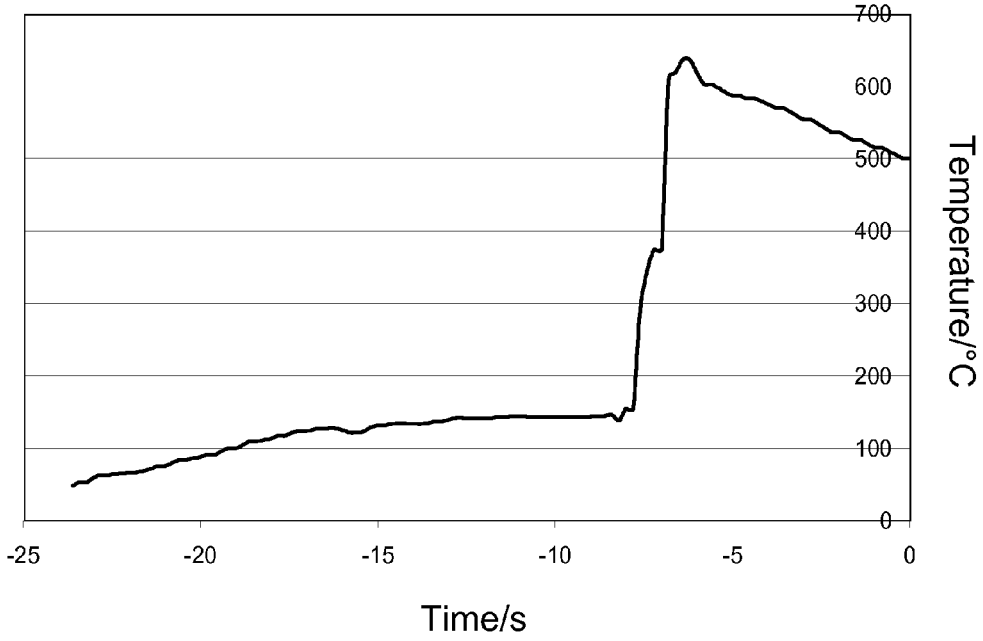

The temperature of the downstream end of the combustible heat source of a smoking article according to the first embodiment of the invention upon ignition of the upstream end of the combustible heat source was measured in the smoking article using a thermocouple attached to the surface of the smoking article at a position (illustrated by line $P_1$ in FIG. 1) 1 mm upstream of the aerosol-generating substrate thereof. The results are shown in FIG. 2*a*.

Figure 2B:
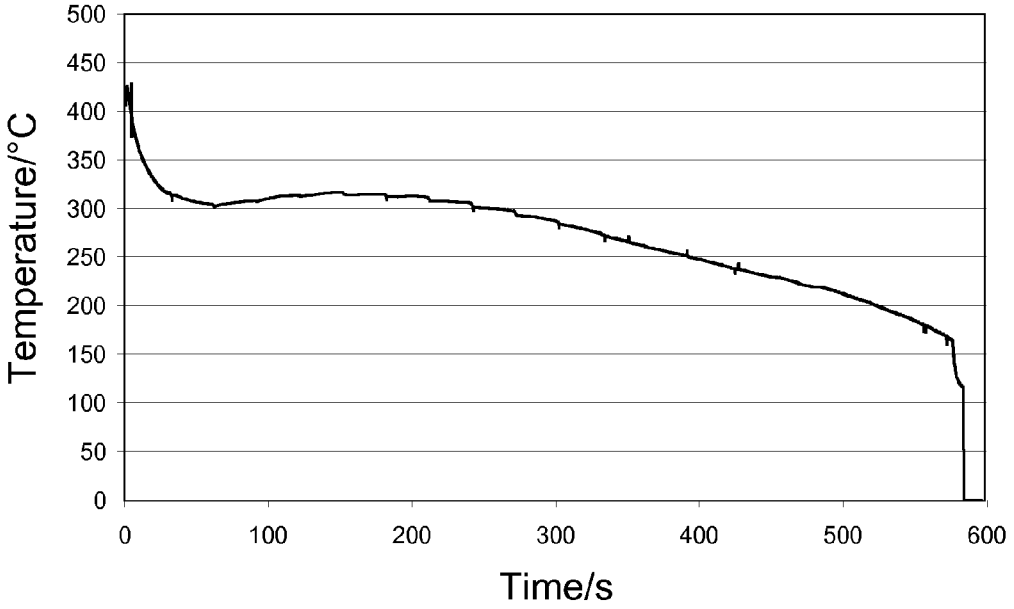

The temperature of the downstream end of the combustible heat source of a smoking article according to the first embodiment of the invention during subsequent combustion of the combustible heat source was also measured in the smoking article using a thermocouple attached to the surface of the smoking article at a position (illustrated by line $P_1$ in FIG. 1) 1 mm upstream of the aerosol-generating substrate thereof. The results are shown in FIG. 2*b*.

Figure 3A:
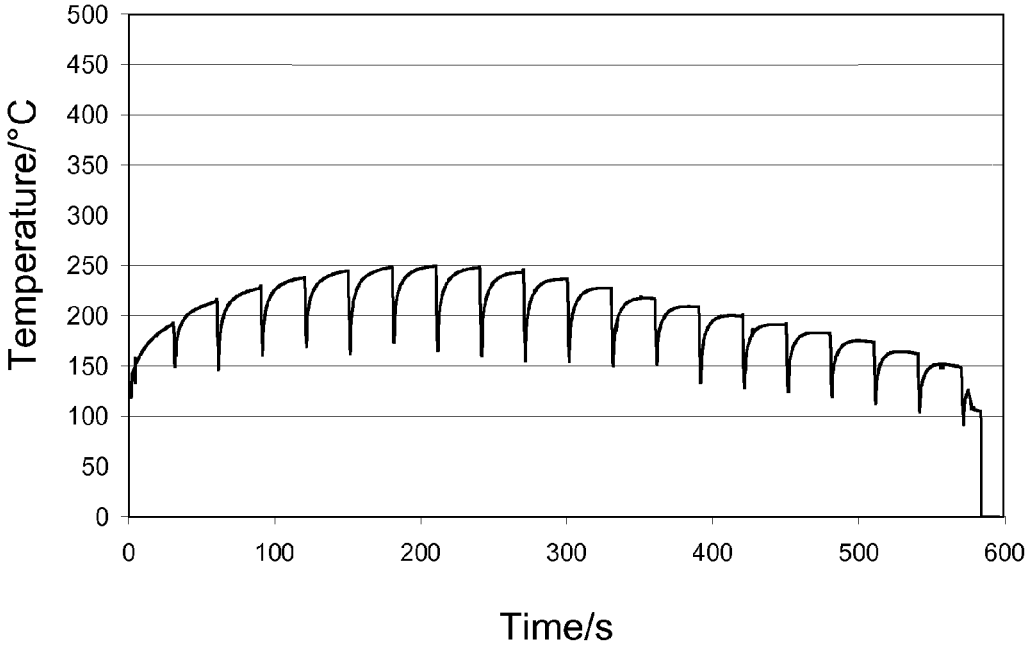

The temperature of the aerosol-generating substrate of the smoking article according to the first embodiment of the invention during combustion of the combustible heat source was measured using a thermocouple attached to the surface of the smoking article at a position (illustrated by line $P_2$ in FIG. 1) 2 mm downstream of the combustible heat source. The results are shown in FIG. 3*a*.

Figure 3B:
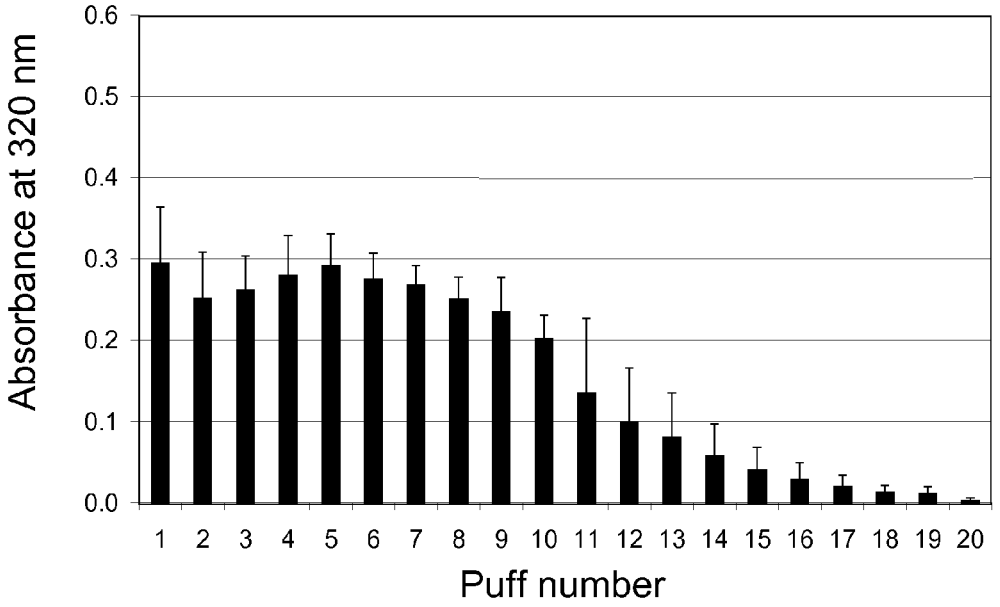

The absorbance of the aerosol generated during each puff of the smoking article according to the first embodiment of the invention was measured using a UV-Visible optical spectrometer with an optical cell set up to record data in the Near UV region at 320 nm. The results, which are indicative of the density of the aerosol generated, are shown in FIG. 3*b*.

To generate the profiles shown in FIGS. 2*a*-3*b*, the combustible heat sources of smoking articles according to the first embodiment of the invention were ignited using a conventional yellow flame lighter. Puffs of 55 ml (puff volume) were then taken in 2 seconds (puff duration) every 30 seconds (puff frequency) using a smoking machine.

EXAMPLE 2

Combustible heat sources according to a second embodiment of the invention were prepared by mixing 639 g of carbon powder, 51.75 g of potassium citrate, 195.5 g of copper oxide (CuO), 111 g of corn, 84 g of modified cellulose, 276 g of flour, 21 g of corn oil and 141.75 g of sugar with 579 g of deionised water to form an aqueous slurry.

The aqueous slurry was then extruded through a die having a central die orifice of circular cross-section with a diameter of 8.7 mm to form cylindrical rods having a length of about 20-22 cm and a diameter of about 9.1-9.2 mm. A single longitudinal air flow passageway was formed in the cylindrical rods by a mandrel of circular cross-section with an outer diameter of approximately 2 mm mounted centrally in the die orifice. During extrusion of the cylindrical rods, a glass coating slurry was pumped through a feed passageway extending through the centre of the mandrel to form a thin coating of about 150-300 microns on the inner surface of the single longitudinal airflow passageway.

The cylindrical rods were dried at about 20-25° C., 40-50 percent relative humidity, for between about 12 hours and about 72 hours and then pyrolysed in a nitrogen atmosphere at 750° C. for about 240 minutes.

After pyrolysis, the cylindrical rods were cut and rectified down to a defined diameter using a grinding machine to form individual combustible heat sources having a length of about 11 mm, a diameter of about 7.8 mm and a dry mass of about 425 mg. The results of an elemental analysis of the combustible heat sources are given in Table 1 below:

TABLE 1

| Element | Amount (weight percent) |
|---|---|
| Calcium | 1 |
| Potassium | 1.9 |
| Copper | 16.6 |
| Carbon | 80 |

X-ray diffraction analysis of the combustible heat sources indicated that the majority of the CuO is reduced to Cu metal during pyrolysis, with minor phases of $Cu_2O$ and CuO present.

The individual combustible heat sources were dried at 130° C. for approximately 1 hour and then placed in an aqueous solution comprising 34 percent by weight of strontium nitrate ($Sr(NO_3)_2$), 16 percent by weight of potassium nitrate ($KNO_3$) and 11 percent by weight of calcium nitrate ($Ca(NO_3)_2*4H_2O$), which was pre-heated to a temperature of between about 80° C. to about 85° C.

After approximately 15 minutes, the individual combustible heat sources were removed from the solution and placed in deionised water for approximately 5 to 30 seconds. The individual combustible heat sources were then removed from the deionised water and dried, first at ambient temperature for approximately 1 hour and then at 130° C. for approximately 1 hour.

The dried individual combustible heat sources had an ignition aid (strontium nitrate, potassium nitrate and calcium nitrate) content of about 33 percent by dry weight of the combustible heat source.

Figure 4A:
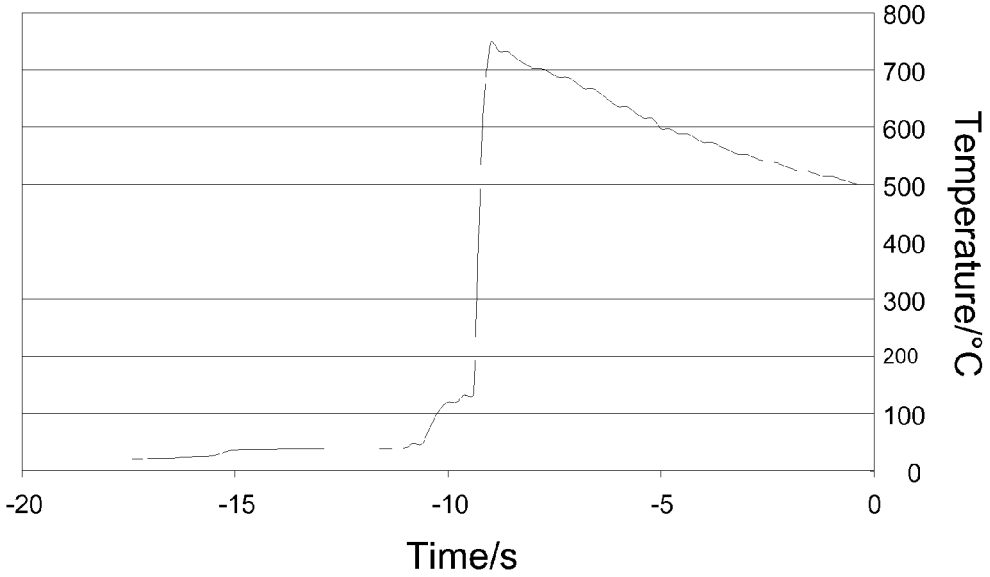

The temperature of the downstream end of the combustible heat source of a smoking article according to the second embodiment of the invention upon ignition of the upstream end of the combustible heat source was measured in the smoking article using thermocouples attached to the surface of the smoking article at a position (illustrated by line $P_1$ in FIG. 1) 1 mm upstream of the aerosol-generating substrate thereof. The results are shown in FIG. 4*a*.

Figure 4B:
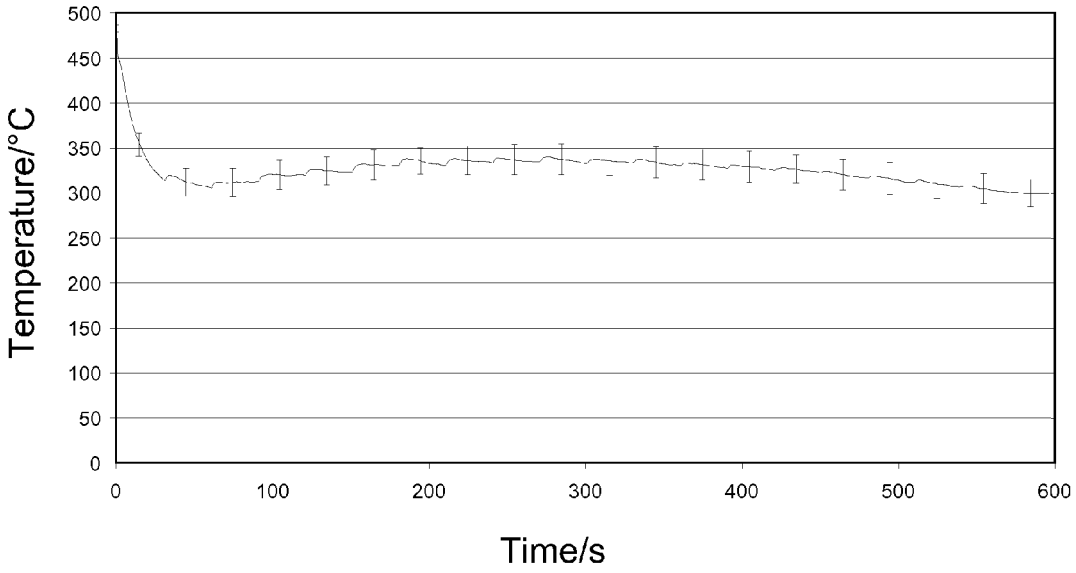

The temperature of the downstream end of the combustible heat source of a smoking article according to the second embodiment of the invention during subsequent combustion of the combustible heat source was also measured in the smoking article using a thermocouple attached to the surface of the smoking article at a position (illustrated by line T1 in FIG. 1) 1 mm upstream of the aerosol-generating substrate thereof. The results are shown in FIG. 4*b*.

Figure 5A:
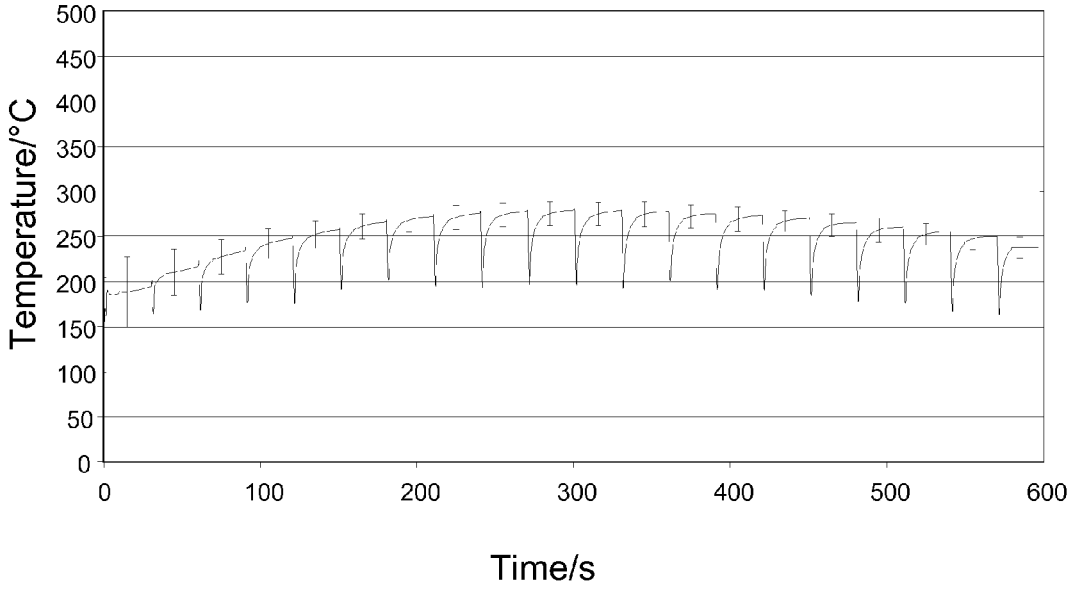

The temperature of the aerosol-generating substrate of the smoking article according to the second embodiment of the invention during combustion of the combustible heat source was measured using a thermocouple attached to the surface of the smoking article at a position (illustrated by line $P_2$ in FIG. 1) 2 mm downstream of the combustible heat source. The results are shown in FIG. 5*a*.

Figure 5B:
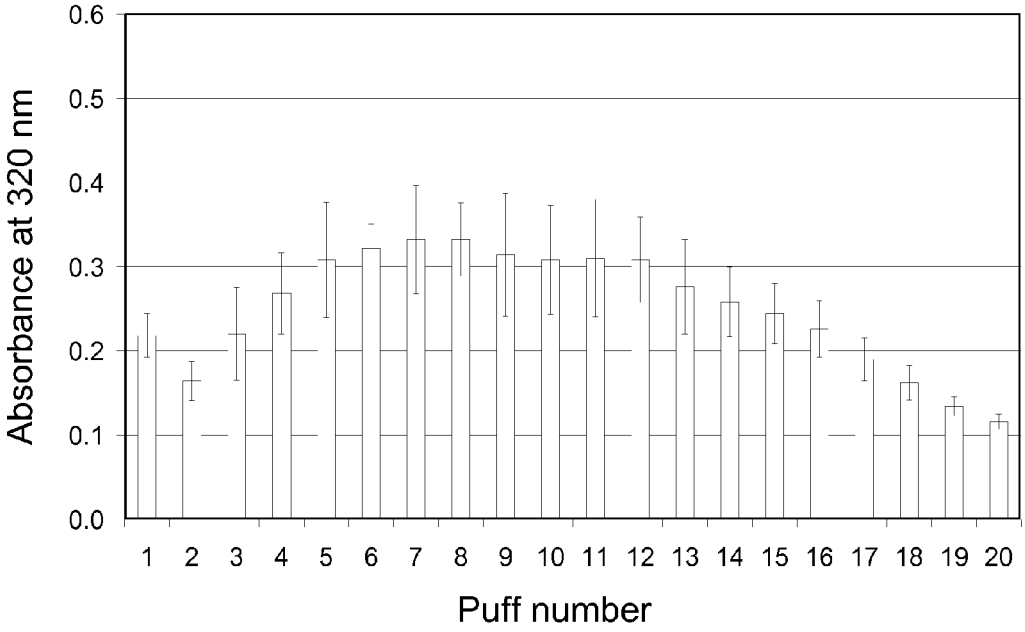

The absorbance of the aerosol generated during each puff of the smoking article according to the second embodiment of the invention was measured using a UV-Visible optical spectrometer with an optical cell set up to record data in the Near UV region at 320 nm. The results, which are indicative of the density of the aerosol generated, are shown in FIG. 5*b*.

To generate the profiles shown in FIGS. 4*a*-5*b*, the upstream ends of the combustible heat sources of the smoking articles according to the second embodiment of the invention were ignited using a conventional yellow flame lighter. Puffs of 55 ml (puff volume) were then taken in 2 seconds (puff duration) every 30 seconds (puff frequency) using a smoking machine.

FIGS. 2*a* and 4*a* show that upon ignition, the temperature of the downstream ends of the combustible heat sources of the smoking articles according to the first and second embodiments of the invention, respectively, rapidly rises to between about 650° C. and about 750° C. as a result of the decomposition of the metal nitrate salts therein.

In both embodiments, the combustion of the carbon in the combustible heat sources propagates at the same time as the decomposition of the metal nitrate salts therein, from the upstream end of the combustible heat sources, where the yellow flame lighter is placed, throughout the entire length of the combustible heat sources. This is clearly shown by a change in colour at the surface of the combustible heat sources due to downstream movement of a deflagration front from the upstream end to the downstream end of the combustible heat sources.

After the initial boost in temperature resulting from decomposition of the metal nitrate salts, the temperature of the downstream ends of the combustible heat sources of the smoking articles according to the first and second embodiments of the invention advantageously falls to a temperature of between about 200° C. and about 350° C., as shown in FIG. 2*b* and FIG. 4*b*, respectively.

As shown in FIGS. 3*a* and 3*b* and FIGS. 6*a* and 6*b*, the initial boost in temperature and rapid ignition of the combustible heat sources of the smoking articles according to the first and second embodiments of the invention resulting from the decomposition of the metal nitrate salts therein, advantageously quickly raises the temperature of the aerosol-generating substrates of the smoking articles to a level at which volatile organic aroma and flavour compounds are generated from the aerosol-generating substrates in sufficient quantities to produce a sensorially acceptable aerosol as of the first puff.

Furthermore, the decrease in temperature of the combustible heat sources of the smoking articles according to the first and second embodiments of the invention following decomposition of the metal nitrates salts therein advantageously ensures that the temperature of the aerosol-generating substrates of the smoking articles does not reach a level at which combustion or thermal degradation of the aerosol-generating substrates occurs.

EXAMPLE 3

Combustible heat sources according to a third embodiment of the invention were prepared by mixing 750 g of carbon powder, 51.75 g of potassium citrate, 84 g of modified cellulose, 276 g of flour, 141.75 g of sugar and 21 g of corn oil with 579 g of deionised water to form an aqueous slurry.

The aqueous slurry was then extruded through a die having a central die orifice of circular cross-section with a diameter of 8.7 mm to form cylindrical rods having a length of about 20-22 cm and a diameter of about 9.1-9.2 mm. A single longitudinal air flow passageway was formed in the cylindrical rods by a mandrel of circular cross-section with an outer diameter of approximately 2 mm mounted centrally in the die orifice. During extrusion of the cylindrical rods, a glass coating slurry was pumped through a feed passageway extending through the centre of the mandrel to form a thin coating of about 150-300 microns on the inner surface of the single longitudinal airflow passageway.

The cylindrical rods were dried at about 20-25° C., 40-50 percent relative humidity, for between about 12 hours and about 72 hours and then pyrolysed in a nitrogen atmosphere at 750° C. for about 240 minutes.

After pyrolysis, the cylindrical rods were cut and shaped to a defined diameter using a grinding machine to form individual combustible heat sources having a length of about 11 mm, a diameter of about 7.8 mm and a dry mass of about 425 mg and then dried at 130° C. for approximately 1 hour.

Figure 6A:
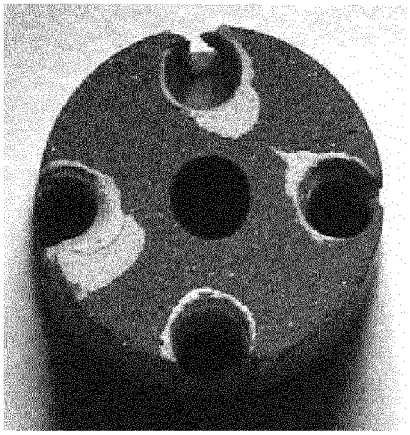
Figure 6B:
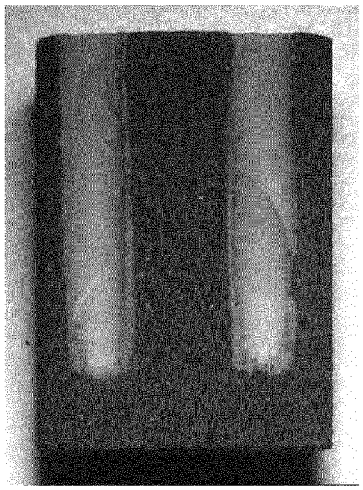

As shown in FIGS. 6*a* and 6*b*, four equally spaced apart longitudinal grooves having a length of 9 mm as measured from the upstream end of the combustible heat source and a diameter of between and 1.5 mm and about 1.8 mm were formed along the circumferential outer surface of each individual combustible heat source using an electric drill. A suspension of 1 percent nitrocellulose binder and 66 percent zirconium by weight in acetone was applied within each of the longitudinal grooves along the circumferential outer surface of the individual combustible-heat sources using a syringe.

The individual combustible heat sources were then dried at 130° C. for approximately 1 hour.

The dried individual combustible heat sources had an ignition aid (zirconium) content of about 20 percent by dry weight of the combustible heat source.

The temperature of the downstream end of the combustible heat source of a smoking article according to the third embodiment of the invention upon ignition of the upstream end of the combustible heat source was measured in the smoking article using thermocouples attached to the surface of the smoking article at a position (illustrated by line $P_1$ in FIG. 1) 1 mm upstream of the aerosol-generating substrate thereof.

The temperature of the downstream end of the combustible heat source of a smoking article according to the third embodiment of the invention during subsequent combustion of the combustible heat source was also measured in the smoking article using a thermocouple attached to the surface of the smoking article at a position (illustrated by line $P_1$ in FIG. 1) 1 mm upstream of the aerosol-generating substrate thereof.

In both cases, the combustible heat sources of the smoking articles according to the third embodiment of the invention were ignited using a conventional yellow flame lighter. Puffs of 55 ml (puff volume) were then taken in 2 seconds (puff duration) every 30 seconds (puff frequency) using a smoking machine.

Upon ignition, the temperature of the downstream end of the combustible heat source of the smoking article according to the third embodiment of the invention rises to about 500° C. as a result of the reaction with oxygen of the zirconium in the four longitudinal grooves disposed about the circumference of the combustible heat source. As illustrated by the reaction scheme below, this reaction is highly exothermic and produces inert zirconium oxide particles:

$$Zr+O_2 \rightarrow ZrO_2+\Delta E(-1081\ kJ/mol)$$

While as shown in FIG. 6*b*, the four longitudinal grooves do not extend from the upstream end to the downstream end of the combustible heat source, they do extend beneath the combustion resistant wrapper of the smoking article according to the third embodiment of the invention. In this embodiment heat generated upon ignition of the upstream end of the combustible heat source as a result of the reaction of the zirconium with oxygen is, therefore, transferred directly by conduction to the aerosol-generating substrate via the combustion resistant wrapper. This advantageously quickly raises the temperature of the aerosol-generating substrate of the smoking article according to the third embodiment of the invention to a level at which volatile organic aroma and flavour compounds are generated from the aerosol-generating substrates in sufficient quantities to produce a sensorially acceptable aerosol as of the first puff.

The exothermic reaction with oxygen of the zirconium in the four longitudinal grooves of the combustible heat source is sufficiently energetic that, as well as heat being transferred to the aerosol-generating substrate of the smoking article via the combustion resistant wrapper, energy is radiated radially throughout the entire combustible heat source. This initiates combustion of the carbon in the combustible heat source.

After the initial boost in temperature resulting from the reaction with oxygen of the zirconium to form zirconium oxide, the temperature of the downstream end of the combustible heat source of the smoking article according to the third embodiment of the invention advantageously also falls to a temperature of between about 200° C. and about 400° C. during subsequent combustion of the combustible heat source. The decrease in temperature of the combustible heat source according to the third embodiment of the invention following the reaction with oxygen of the zirconium therein advantageously ensures that the temperature of the aerosol-generating substrate of the smoking article according to the third embodiment of the invention does not reach a level at which combustion or thermal degradation of the aerosol-generating substrate occurs.

In the third embodiment of the invention described above, zirconium is deposited in four equally spaced apart longitudinal grooves disposed about the circumference of the combustible heat source. However, it will be appreciated that zirconium and other materials that release energy upon ignition of the upstream end of the combustible heat sources may be deposited or otherwise provided in more than four or fewer than four grooves disposed about the circumference of combustible heat sources according to invention.

It will also be appreciated that combustible heat sources according to the invention may comprise one or materials that release energy upon ignition of the upstream end of the combustible heat sources in other locations.

EXAMPLE 4

Combustible heat sources according to a fourth embodiment of the invention were prepared by mixing 135 g of carbon powder, 150 g of calcium peroxide (75 percent purity) and 15 g of carboxymethyl cellulose with 180 g of deionised water to form a granulated mixture.

The granulated mixture was then extruded through a die having a central die orifice of circular cross-section with a diameter of 7.6 mm to form cylindrical rods having a length of about 20-25 cm and a diameter of about 7.8 mm. A single longitudinal air flow passageway was formed in the cylindrical rods by a mandrel of circular cross-section with an outer diameter of approximately 2 mm mounted centrally in the die orifice. A clay coating slurry was applied to the inner surface of the single longitudinal air flow passageway to form a thin coating of about 150-300 microns on the inner surface of the single longitudinal air flow passageway.

The cylindrical rods were dried at about 20-25° C., 40-50 percent relative humidity, for between about 12 hours and about 48 hours. After drying, the cylindrical rods were cut to form individual combustible heat sources having a length of about 13 mm and a diameter of about 7.8 mm. The individual combustible heat sources were then dried at 130° C.

for approximately 1 hour. The dried individual combustible heat sources had a mass of about 500 mg.

The dried individual combustible heat sources had an ignition aid (calcium peroxide) content of about 38 percent by dry weight of the combustible heat source.

The temperature of the downstream end of the combustible heat source of a smoking article according to the fourth embodiment of the invention upon ignition of the upstream end of the combustible heat source was measured in the smoking article using a thermocouple attached to the surface of the smoking article at a position (illustrated by line $P_1$ in FIG. 1) 1 mm upstream of the aerosol-generating substrate thereof. The results are shown in FIG. 7.

Figure 7:
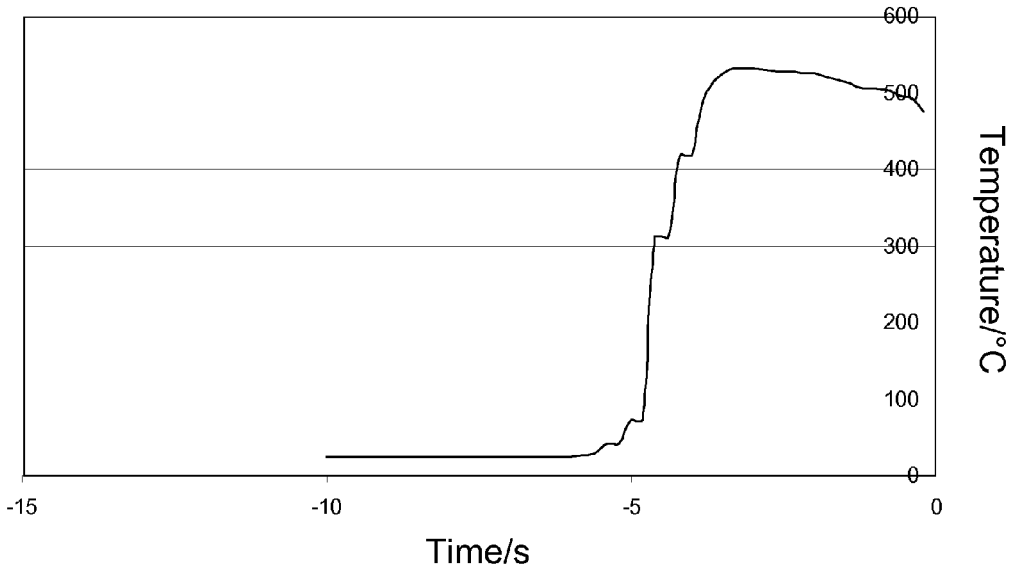
FIG. 7 shows a graph of the temperature of the downstream end of the combustible heat source of a smoking article according to a fourth embodiment of the invention upon ignition of the upstream end thereof.

To generate the profile shown in FIG. 7, the upstream end of the combustible heat source of the smoking article according to the fourth embodiment of the invention was ignited using a conventional yellow flame lighter. Puffs of 55 ml (puff volume) were then taken in 2 seconds (puff duration) every 30 seconds (puff frequency) using a smoking machine.

FIG. 7 shows that upon ignition, the temperature of the downstream end of the combustible heat source of the smoking article according to the fourth embodiment of the invention rapidly rises to between about 500° C. and about 600° C. as a result of the decomposition of the calcium peroxide therein.

The combustion of the carbon in the combustible heat source propagates at the same time as the decomposition of the calcium peroxide therein, from the upstream end of the combustible heat source, where the yellow flame lighter is placed, throughout the entire length of the combustible heat source. This is clearly shown by a change in colour at the surface of the combustible heat source due to downstream movement of a deflagration front from the upstream end to the downstream end of the combustible heat source.

After the initial boost in temperature resulting from the decomposition of the calcium peroxide, the temperature of the downstream end of the combustible heat source of the smoking article according to the fourth embodiment of the invention advantageously falls to a temperature of below about 375° C.

The initial boost in temperature and rapid ignition of the combustible heat source of the smoking article according to the fourth embodiment of the invention resulting from the decomposition of the calcium peroxide therein, advantageously quickly raises the temperature of the aerosol-generating substrate of the smoking article to a level at which volatile organic aroma and flavour compounds are generated from the aerosol-generating substrate in sufficient quantities to produce a sensorially acceptable aerosol as of the first puff.

Furthermore, the decrease in temperature of the combustible heat source of the smoking article according to the fourth embodiment of the invention following decomposition of the calcium peroxide therein advantageously ensures that the temperature of the aerosol-generating substrate of the smoking article does not reach a level at which combustion or thermal degradation of the aerosol-generating substrate occurs.

EXAMPLE 5

Combustible heat sources according to a fifth embodiment of the invention and a sixth embodiment of the invention having the ignition aid (calcium peroxide) contents shown in Table 2 were prepared as in Example 4 by the mixing the components shown in Table 2 to form a granulated mixture.

First comparative combustible heat sources and second comparative combustible heat sources having the ignition aid (calcium peroxide) contents shown in Table 2 were also prepared as in Example 4 by the mixing components shown in Table 2 to form a granulated mixture.

The temperature of the downstream end of the combustible heat sources of: (i) a smoking article according to a fifth embodiment of the invention; (ii) a smoking article according to a sixth embodiment of the invention; (iii) a first comparative smoking article; and (iv) a second comparative smoking article upon ignition of the upstream end of the combustible heat sources was measured in the smoking article using a thermocouple attached to the surface of the smoking article at a position (illustrated by line $P_1$ in FIG. 1) 1 mm upstream of the aerosol-generating substrate thereof. The results are shown in FIG. 8.

TABLE 2

| | Combustible Heat Source | | | |
|---|---|---|---|---|
| | Fifth Embodiment | Sixth Embodiment | First comparative | Second Comparative |
| Carbon powder (g) | 45 | 55 | 60 | 65 |
| Calcium peroxide (75 percent purity) (g) | 50 | 40 | 35 | 30 |
| Carboxymethyl cellulose (g) | 5 | 5 | 5 | 5 |
| Deionised water (g) | 60 | 61 | 61 | 62 |
| Ignition aid (calcium peroxide) content (percent by dry weight of the combustible heat source) | 38 | 30 | 26 | 23 |

Figure 8:
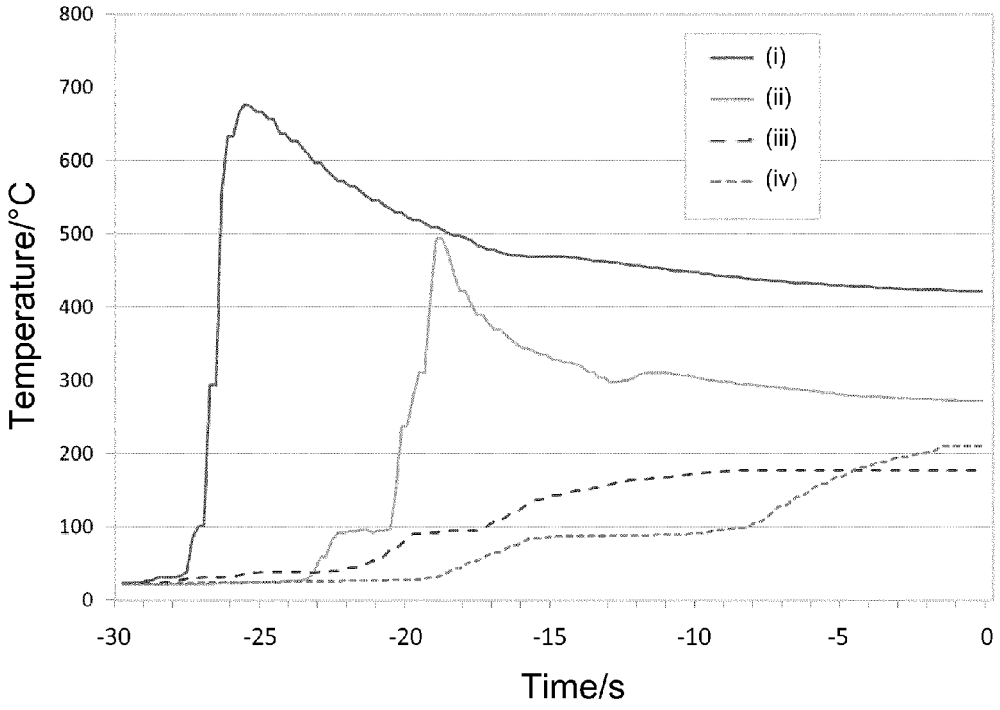
FIG. 8 shows a graph of the temperature of the downstream end of the combustible heat sources of: (i) a smoking article according to a fifth embodiment of the invention; (ii) a smoking article according to a sixth embodiment of the invention; (iii) a first comparative smoking article; and (iv) a second comparative smoking article upon ignition of the upstream ends thereof.

To generate the profiles shown in FIG. 8, the upstream ends of the combustible heat sources of the: (i) smoking article according to a fifth embodiment of the invention; (ii) smoking article according to the sixth embodiment of the invention; (iii) first comparative smoking article; and (iv) second comparative smoking article were ignited using a conventional yellow flame lighter. Puffs of 55 ml (puff volume) were then taken in 2 seconds (puff duration) every 30 seconds (puff frequency) using a smoking machine.

FIG. 8 shows that upon ignition, the temperature of the downstream end of the combustible heat source of the smoking article according to the fifth embodiment of the invention, which has a calcium peroxide content of about 38 percent by dry weight of the combustible heat source, rapidly rises to between about 650° C. and about 750° C. as a result of the decomposition of the calcium peroxide therein.

FIG. 8 also shows that upon ignition, the temperature of the downstream end of the combustible heat source of the smoking article according to the sixth embodiment of the invention, which has a calcium peroxide content of about 30 percent by dry weight of the combustible heat source, rapidly rises to between about 450° C. and about 500° C. as a result of the decomposition of the calcium peroxide therein.

However, upon ignition, the temperature of the downstream end of the combustible heat source of the first comparative smoking article, which has a calcium peroxide content of about 26 percent by dry weight of the combustible heat source, and the temperature of the downstream end of the combustible heat source of the second comparative smoking article, which has a calcium peroxide content of about 23 percent by dry weight of the combustible heat source, do not exhibit a 'boost' in temperature.

As shown in FIG. 8, reducing the amount of calcium peroxide in the combustible heat source reduces the magnitude of the 'boost' in temperature of the downstream end of the combustible heat source obtained upon ignition of the upstream end of the combustible heat source. As also shown in FIG. 8, reducing the amount of calcium peroxide in the combustible heat source increases the time taken for the downstream end of the combustible heat source to reach the 'boost' temperature upon ignition of the upstream end of the combustible heat source.

Combustible heat sources according to the invention must comprise at least one ignition aid in an amount of at least about 20 percent by dry weight of the combustible heat source. However, FIG. 8 illustrates that the amount of at least one ignition aid that must be included in order for the second portion of a combustible heat source according to the invention to exhibit the required 'boost' in temperature upon ignition of the first portion thereof may be greater than about 20 percent by dry weight of the combustible heat source depending on the specific at least one ignition aid included in the combustible heat source.

EXAMPLE 6

Combustible heat sources according to a seventh embodiment of the invention were prepared by mixing 180 g of carbon powder, 90 g of calcium peroxide (75 percent purity), 15 g of magnesium and 15 g of carboxymethyl cellulose with 180 g of deionised water to form a granulated mixture.

The granulated mixture was then extruded through a die having a central die orifice of circular cross-section with a diameter of 7.6 mm to form cylindrical rods having a length of about 20-25 cm and a diameter of about 7.8 mm. A single longitudinal air flow passageway was formed in the cylindrical rods by a mandrel of circular cross-section with an outer diameter of approximately 2 mm mounted centrally in the die orifice. A clay coating slurry was applied to the inner surface of the single longitudinal air flow passageway to form a thin coating of about 150-300 microns on the inner surface of the single longitudinal air flow passageway.

The cylindrical rods were dried at about 20-25° C., 40-50 percent relative humidity, for between about 12 hours and about 48 hours. After drying, the cylindrical rods were cut to form individual combustible heat sources having a length of about 13 mm and a diameter of about 7.8 mm. The individual combustible heat sources were then dried at 130° C. for approximately 1 hour. The dried individual combustible heat sources had a mass of about 500 mg.

The dried individual combustible heat sources had an ignition aid (calcium peroxide and magnesium) content of about 28 percent by dry weight of the combustible heat source.

The temperature of the downstream end of the combustible heat source of a smoking article according to the seventh embodiment of the invention upon ignition of the upstream end of the combustible heat source was measured in the smoking article using a thermocouple attached to the surface of the smoking article at a position (illustrated by line $P_1$ in FIG. 1) 1 mm upstream of the aerosol-generating substrate thereof. The results are shown in FIG. 9*a*.

The temperature of the downstream end of the combustible heat source of a smoking article according to the seventh embodiment of the invention during subsequent combustion of the combustible heat source was also measured in the smoking article using a thermocouple attached to the surface of the smoking article at a position (illustrated by line $P_1$ in FIG. 1) 1 mm upstream of the aerosol-generating substrate thereof. The results are shown in FIG. 9*b*.

To generate the profiles shown in FIGS. 9*a* and 9*b*, the upstream end of the combustible heat source of the smoking article according to the seventh embodiment of the invention was ignited using a conventional yellow flame lighter. Puffs of 55 ml (puff volume) were then taken in 2 seconds (puff duration) every 30 seconds (puff frequency) using a smoking machine.

FIG. 9*a* shows that upon ignition, the temperature of the downstream end of the combustible heat source of the smoking article according to the seventh embodiment of the invention rapidly rises to between about 600° C. and about 700° C. as a result of the decomposition of the calcium peroxide therein and the exothermic reaction with oxygen of the magnesium therein.

The combustion of the carbon in the combustible heat source propagates at the same time as the decomposition of the calcium peroxide therein and the reaction with oxygen of the magnesium therein, from the upstream end of the combustible heat source, where the yellow flame lighter is placed, throughout the entire length of the combustible heat source. This is clearly shown by a change in colour at the surface of the combustible heat source due to downstream movement of a deflagration front from the upstream end to the downstream end of the combustible heat source.

After the initial boost in temperature resulting from the decomposition of the calcium peroxide and the reaction with oxygen of the magnesium, the temperature of the downstream end of the combustible heat source of the smoking article according to the seventh embodiment of the invention advantageously falls to a temperature of between about 250° C. and about 400° C. as shown in FIG. 9*b*.

The initial boost in temperature and rapid ignition of the combustible heat source of the smoking article according to the seventh embodiment of the invention resulting from the decomposition of the calcium peroxide therein and the reaction with oxygen of the magnesium therein, advantageously quickly raises the temperature of the aerosol-generating substrate of the smoking article to a level at which volatile organic aroma and flavour compounds are generated from the aerosol-generating substrate in sufficient quantities to produce a sensorially acceptable aerosol as of the first puff.

Furthermore, the decrease in temperature of the combustible heat source of the smoking article according to the seventh embodiment of the invention following decomposition of the calcium peroxide therein and the reaction with oxygen of the magnesium therein advantageously ensures that the temperature of the aerosol-generating substrate of the smoking article does not reach a level at which combustion or thermal degradation of the aerosol-generating substrate occurs.

EXAMPLE 7

Combustible heat sources according to an eighth embodiment of the invention were prepared by mixing 525 g of carbon powder, 225 g of calcium carbonate ($CaCO_3$), 51.75 g of potassium citrate, 84 g of modified cellulose, 276 g of flour, 141.75 g of sugar and 21 g of corn oil with 579 g of deionised water to form an aqueous slurry.

The aqueous slurry was then extruded through a die having a central die orifice of circular cross-section with a diameter of 8.7 mm to form cylindrical rods having a length of about 20-22 cm and a diameter of about 9.1-9.2 mm. A single longitudinal air flow passageway was formed in the cylindrical rods by a mandrel of circular cross-section with an outer diameter of approximately 2 mm mounted centrally in the die orifice. During extrusion of the cylindrical rods, a glass coating slurry was pumped through a feed passageway extending through the centre of the mandrel to form a thin coating of about 150-300 microns on the inner surface of the single longitudinal airflow passageway.

The cylindrical rods were dried at about 20-25° C., 40-50 percent relative humidity, for between about 12 hours and about 72 hours and then pyrolysed in a nitrogen atmosphere at 750° C. for about 240 minutes.

After pyrolysis, the cylindrical rods were cut and shaped to a defined diameter using a grinding machine to form individual combustible heat sources having a length of about 11 mm, a diameter of about 7.8 mm and a dry mass of about 400 mg.

The individual combustible heat sources were dried at 130° C. for approximately 1 hour and then placed in an aqueous solution of nitric acid having a concentration of 38 percent by weight, which was saturated with potassium nitrate ($KNO_3$).

After approximately 5 minutes, the individual combustible heat sources were removed from the solution and dried at 130° C. for approximately 1 hour.

After drying the individual combustible heat sources were placed in an aqueous solution of sodium chlorate ($NaClO_3$) having a concentration of 0.98 mol/L.

After approximately 30 seconds, the individual combustible heat sources were removed from the solution and dried for 10 minutes at room temperature, then at 120° C. for approximately 1 hour.

The dried individual combustible heat sources had an ignition aid (calcium nitrate, potassium nitrate and sodium chlorate) content of between about 30 percent and about 40 percent by dry weight of the combustible heat source.

The temperature of the downstream end of the combustible heat source of a smoking article according to the eighth embodiment of the invention upon ignition of the upstream end of the combustible heat source was measured in the smoking article using a thermocouple attached to the surface of the smoking article at a position (illustrated by line $P_1$ in FIG. 1) 1 mm upstream of the aerosol-generating substrate thereof. The results are shown in FIG. 10.

To generate the profile shown in FIG. 10, the upstream end of the combustible heat source of the smoking article according to the eighth embodiment of the invention was ignited using a conventional yellow flame lighter. Puffs of 55 ml (puff volume) were then taken in 2 seconds (puff duration) every 30 seconds (puff frequency) using a smoking machine.

FIG. 10 shows that upon ignition, the temperature of the downstream end of the combustible heat source of the smoking article according to the eighth embodiment of the invention rapidly rises to between about 650° C. and about 700° C. as a result of the decomposition of the metal nitrate salts and metal chlorate salt therein therein.

After the initial boost in temperature resulting from decomposition of the metal nitrate salts and metal chlorate salt, the temperature of the downstream end of the combustible heat source of the smoking article according to the eighth embodiment of the invention falls to a temperature of below about 500° C.

EXAMPLE 8

Combustible heat sources according to a ninth embodiment of the invention were prepared by mixing 35 g of carbon powder, 35.9 g of iron oxide ($Fe_2O_3$), 16.4 g of magnesium, 6 g of bentonite and 6.7 g of carboxymethyl cellulose with 73.3 g of deionised water to form a granulated mixture.

The granulated mixture was then extruded through a die having a central die orifice of circular cross-section with a diameter of 7.6 mm to form cylindrical rods having a length of about 20-25 cm and a diameter of about 7.8 mm.

The cylindrical rods were dried at about 20-25° C., 40-50 percent relative humidity, for between about 12 hours and about 48 hours. After drying, the cylindrical rods were cut to form individual combustible heat sources having a length of about 11 mm and a diameter of about 7.8 mm. The individual combustible heat sources were then dried at 130° C. for approximately 1 hour. The dried individual combustible heat sources had a mass of about 400 mg.

The dried individual combustible heat sources had an ignition aid (iron oxide ($Fe_2O_3$) and magnesium) content of about 52 percent by dry weight of the combustible heat source.

The temperature of the downstream end of the combustible heat source of a smoking article according to the ninth embodiment of the invention upon ignition of the upstream end of the combustible heat source was measured in the smoking article using a thermocouple attached to the surface of the smoking article at a position (illustrated by line $P_1$ in FIG. 1) 1 mm upstream of the aerosol-generating substrate thereof. The results are shown in FIG. 11.

To generate the profile shown in FIG. 11, the upstream end of the combustible heat source of the smoking article according to the ninth embodiment of the invention was ignited using a conventional yellow flame lighter. Puffs of 55 ml (puff volume) were then taken in 2 seconds (puff duration) every 30 seconds (puff frequency) using a smoking machine.

FIG. 11 shows that upon ignition, the temperature of the downstream end of the combustible heat source of the smoking article according to the ninth embodiment of the invention rapidly rises to between about 1000° C. and about 1100° C. as a result of the exothermic reaction between the iron oxide ($Fe_2O_3$) and the magnesium therein.

After the initial boost in temperature resulting from the exothermic reaction between the iron oxide ($Fe_2O_3$) and the magnesium, the temperature of the downstream end of the combustible heat source of the smoking article according to the ninth embodiment of the invention falls to a temperature of below about 500° C.

EXAMPLE 9

Third comparative combustible heat sources and fourth comparative combustible heat sources having the ignition aid (iron oxide ($Fe_2O_3$) and magnesium) contents shown in Table 2 were prepared as in Example 8 by mixing the components shown in Table 3 to form a granulated mixture.

The temperature of the downstream end of the combustible heat sources of: (i) a smoking article according to the ninth embodiment of the invention; (ii) a third comparative smoking article; and (iii) a fourth comparative smoking article upon ignition of the upstream end of the combustible heat sources was measured in the smoking article using a thermocouple attached to the surface of the smoking article at a position (illustrated by line $P_1$ in FIG. 1) 1 mm upstream of the aerosol-generating substrate thereof. The results are shown in FIG. 12.

To generate the profiles shown in FIG. 12, the upstream ends of the combustible heat sources of the (i) smoking article according to the ninth embodiment of the invention; (ii) third comparative smoking article; and (iii) fourth comparative smoking article were ignited using a conventional yellow flame lighter. Puffs of 55 ml (puff volume) were then taken in 2 seconds (puff duration) every 30 seconds (puff frequency) using a smoking machine.

TABLE 3

| | Combustible Heat Source | |
|---|---|---|
| | Third comparative | Fourth Comparative |
| Carbon powder (g) | 40 | 45 |
| Iron oxide ($Fe_2O_3$) (g) | 32.6 | 29.3 |
| Magnesium (g) | 14.9 | 13.4 |
| Bentonite (g) | 6 | 6 |
| Carboxymethyl cellulose (g) | 6.5 | 6.3 |
| Deionised water (g) | 73.3 | 73.3 |
| Ignition aid (Iron oxide ($Fe_2O_3$) and magnesium) content (percent by dry weight of the combustible heat source) | 48 | 43 |

FIG. 12 shows that upon ignition, the temperature of the downstream end of the combustible heat source of the smoking article according to the ninth embodiment of the invention, which has an iron oxide ($Fe_2O_3$) and magnesium content of about 52 percent by dry weight of the combustible heat source, rapidly rises to between about 1000° C. and about 1100° C. as a result of the exothermic reaction between the iron oxide ($Fe_2O_3$) and the magnesium therein.

However, upon ignition, the temperature of the downstream end of the combustible heat source of the third comparative smoking article, which has an iron oxide ($Fe_2O_3$) and magnesium content of about 48 percent by dry weight of the combustible heat source, and the temperature of the downstream end of the combustible heat source of the fourth comparative smoking article, which has an iron oxide ($Fe_2O_3$) and magnesium content of about 43 percent by dry weight of the combustible heat source, do not exhibit a 'boost' in temperature.

As shown in FIG. 12, reducing the iron oxide ($Fe_2O_3$) and magnesium content of the combustible heat source reduces the magnitude of the 'boost' in temperature of the downstream end of the combustible heat source obtained upon ignition of the upstream end of the combustible heat source.

Combustible heat sources according to the invention must comprise at least one ignition aid in an amount of at least about 20 percent by dry weight of the combustible heat source. However, FIG. 12 illustrates that the amount of at least one ignition aid that must be included in order for the second portion of a combustible heat source according to the invention to exhibit the required 'boost' in temperature upon ignition of the first portion thereof may be greater than about 20 percent by dry weight of the combustible heat source depending on the specific at least one ignition aid included in the combustible heat source.

EXAMPLE 10

Fifth comparative combustible heat sources and sixth comparative combustible heat sources were prepared as in Example 4 by mixing the components shown in Table 4 to form a granulated mixture.

| | Combustible Heat Source | |
|---|---|---|
| | Fifth comparative | Sixth Comparative |
| Carbon powder (g) | 285 | 135 |
| Carboxymethyl cellulose (g) | 15 | 15 |
| Potassium citrate (g) | — | 150 |
| Deionised water (g) | 180 | 75 |
| Alkali metal burn salt (potassium citrate) content (percent by dry weight of the combustible heat source) | — | 50 |

The temperature of the downstream end of the combustible heat sources of: (i) a smoking article according to the fourth embodiment of the invention; (ii) a fifth comparative smoking article; and (iii) a sixth comparative smoking article upon ignition of the upstream end of the combustible heat sources was measured in the smoking article using a thermocouple attached to the surface of the smoking article at a position (illustrated by line $P_1$ in FIG. 1) 1 mm upstream of the aerosol-generating substrate thereof. The results are shown in FIG. 13.

To generate the profiles shown in FIG. 13, the upstream ends of the combustible heat sources of the (i) smoking article according to the fourth embodiment of the invention; (ii) fifth comparative smoking article; and (iii) sixth comparative smoking article were ignited using a conventional yellow flame lighter. Puffs of 55 ml (puff volume) were then taken in 2 seconds (puff duration) every 30 seconds (puff frequency) using a smoking machine.

FIG. 13 shows that upon ignition, the temperature of the downstream end of the combustible heat source of the smoking article according to the fourth embodiment of the invention, which has a calcium peroxide content of about 38 percent by dry weight of the combustible heat source, rapidly rises to between about 750° C. and about 800° C. as a result of the decomposition of the calcium peroxide therein, However, upon ignition, the temperature of the downstream end of the combustible heat source of the fifth comparative smoking article, which contains no ignition aid, and the temperature of the downstream end of the combustible heat source of the sixth comparative smoking article, which has an alkali metal burn salt (potassium citrate) content of about 50 percent by dry weight of the combustible heat source, do not exhibit a 'boost' in temperature.

As shown in FIG. 13, in the absence of at least one ignition aid in an amount of at least about 20 percent by dry weight of the combustible heat source, the second portion of a combustible heat source does not exhibit a 'boost' in temperature upon ignition of the first portion thereof.

As also shown in FIG. 13, even when included in an amount much greater than at least about 20 percent by dry weight of the combustible heat source, alkali metal citrate burn salts do not release enough energy upon ignition of the first portion of a combustible heat source to produce a 'boost' in temperature of the second portion thereof.

The invention claimed is:

1. A combustible heat source for a smoking article comprising carbon and at least one ignition aid selected from the group consisting of metal nitrate salts having a thermal decomposition temperature of less than about 600° C., chlorates, peroxides, thermitic materials, intermetallic materials, magnesium, zirconium, and combinations thereof, wherein the at least one ignition aid is present in an amount of at least about 20 percent by dry weight of the combustible heat source, the combustible heat source comprising a first portion and an opposed second portion, wherein at least part of the combustible heat source between the first portion and the second portion is wrapped in a combustion resistant wrapper that is one or both of heat conducting and substantially oxygen impermeable, and wherein upon ignition of the first portion of the combustible heat source the second portion of the combustible heat source increases in temperature to a first temperature and wherein during subsequent combustion of the combustible heat source the second portion of the combustible heat source maintains a second temperature lower than the first temperature.

2. A combustible heat source according to claim 1 wherein the at least one ignition aid is present in an amount of less than about 65 percent by dry weight of the combustible heat source.

3. A combustible heat source according to claim 1 wherein the combustible heat source is substantially cylindrical and the first portion of the combustible heat source is a first end face of the combustible heat source and the second portion of the combustible heat source is an opposed second end face of the combustible heat source.

4. A combustible heat source according to claim 1 wherein the temperature of the second portion of the combustible heat source remains substantially stable at the second temperature for at least about 3 minutes.

5. A combustible heat source according to claim 1 wherein the first temperature is between about 400° C. and about 1200° C.

6. A combustible heat source according to claim 1 wherein the second temperature is between about 200° C. and about 1000° C.

7. A combustible heat source according to claim 1 wherein the second temperature is between about 200° C. and about 1000° C. lower than the first temperature.

8. A combustible heat source according to claim 1 wherein the ignition temperature of the first portion is between about 200° C. and about 1000° C.

9. A combustible heat source according to claim 1 wherein the at least one ignition aid comprises a peroxide.

10. A combustible heat source according to claim 1 further comprising one or more binders.

11. A combustible heat source according to claim 10 comprising:

one or more organic binders selected from the group consisting of gums, modified celluloses and cellulose derivatives, wheat flour, starches, sugars, vegetable oils, and combinations thereof;

one or more inorganic binders selected from the group consisting of clays, alumino-silicate derivatives, alkali activated alumino-silicates, alkali silicates, limestone derivatives, alkaline earth compounds and derivatives, and aluminium compounds and derivatives;

or a combination thereof.

12. A combustible heat source according to claim 1 wherein upon ignition of the first portion of the combustible heat source the second portion of the combustible heat source increases in temperature to the first temperature at a rate of between about 100° C./second and about 1000° C./second.

13. A smoking article comprising a combustible heat source according to claim 1.

14. A smoking article comprising:

a combustible heat source according to claim 1; and an aerosol-generating substrate downstream of the combustible heat source, wherein the first portion of the combustible heat source is an upstream end of the combustible heat source and the second portion of the combustible heat source is a downstream end of the combustible heat source.

15. A smoking article according to claim 14 wherein at least a rear part of the combustible heat source is wrapped in the combustion resistant wrapper.

16. A smoking article according to claim 15 wherein at least a rear part of the combustible heat source and at least a front part of the aerosol-generating substrate are wrapped in the combustion resistant wrapper.

17. A smoking article according to claim 16 wherein a rear part of the aerosol-generating substrate is not wrapped in the combustion resistant wrapper.

18. A smoking article according to claim 14 wherein a front part of the combustible heat source is not wrapped in the combustion resistant wrapper.

19. A smoking article according to claim 14 wherein the combustible heat source is wrapped in the combustion resistant wrapper along substantially its entire length.

20. A smoking article according to claim 14 wherein the combustible heat source is substantially cylindrical.

21. A smoking article comprising:

an aerosol-generating substrate; and a combustible heat source upstream from the aerosol-generating substrate, the combustible heat source comprising;

carbon and at least one ignition aid selected from the group consisting of metal nitrate salts having a thermal decomposition temperature of less than about 600° C., chlorates, peroxides, thermitic materials, intermetallic materials, magnesium, zirconium, and combinations thereof, wherein the at least one ignition aid is present in an amount of at least about 20 percent by dry weight of the combustible heat source, the combustible heat source comprising a first portion being an upstream end and an opposed second portion being a downstream end, wherein at least part of the combustible heat source between the first portion and the second portion is wrapped in a combustion resistant wrapper that is one or both of heat conducting and substantially oxygen impermeable, and wherein upon ignition of the first portion of the combustible heat source the second portion of the combustible heat source increases in temperature to a first temperature and wherein during subsequent combustion of the combustible heat source the second portion of the combustible heat source maintains a second temperature lower than the first temperature.

22. A smoking article according to claim 21 wherein upon ignition of the first portion of the combustible heat source the second portion of the combustible heat source increases in temperature to the first temperature at a rate of between about 100° C./second and about 1000° C./second.

23. A combustible heat source for a smoking article comprising carbon and at least one ignition aid, wherein the at least one ignition aid is present in an amount of at least about 20 percent by dry weight of the combustible heat source and wherein the at least one ignition aid comprises a peroxide or superoxide that actively evolves oxygen at a temperature of less than about 600° C., the combustible heat source comprising a first portion and an opposed second portion, wherein at least part of the combustible heat source between the first portion and the second portion is wrapped in a combustion resistant wrapper that is one or both of heat conducting and substantially oxygen impermeable, and wherein upon ignition of the first portion of the combustible heat source the second portion of the combustible heat source increases in temperature to a first temperature and wherein during subsequent combustion of the combustible heat source the second portion of the combustible heat source maintains a second temperature lower than the first temperature.

24. A smoking article comprising:

an aerosol-generating substrate; and a combustible heat source upstream from the aerosol-generating substrate, the combustible heat source comprising:

carbon and at least one ignition aid, wherein the at least one ignition aid is present in an amount of at least about 20 percent by dry weight of the combustible heat source and wherein the at least one ignition aid comprises a peroxide or superoxide that actively evolves oxygen at a temperature of less than about 600° C., the combustible heat source comprising a first portion being an upstream end and an opposed second portion being a downstream end, wherein at least part of the combustible heat source between the first portion and the second portion is wrapped in a combustion resistant wrapper that is one or both of heat conducting and substantially oxygen impermeable, and wherein upon ignition of the first portion of the combustible heat source the second portion of the combustible heat source increases in temperature to a first temperature and wherein during subsequent combustion of the combustible heat source the second portion of the combustible heat source maintains a second temperature lower than the first temperature.

* * * * *